US006862962B1

(12) United States Patent
Delbrugge, Jr. et al.

(10) Patent No.: US 6,862,962 B1
(45) Date of Patent: Mar. 8, 2005

(54) SELF-ADJUSTING HAND TOOLS UTILIZING A CAM

(75) Inventors: Gerald Vincent Delbrugge, Jr., Indiana, PA (US); Eric Colburn, Wexford, PA (US)

(73) Assignee: Oberg Industries, Freeport, PA (US)

( * ) Notice: Subject to any disclaimer, the term of this patent is extended or adjusted under 35 U.S.C. 154(b) by 164 days.

(21) Appl. No.: 10/161,938

(22) Filed: Jun. 4, 2002

Related U.S. Application Data

(63) Continuation-in-part of application No. 10/068,375, filed on Feb. 5, 2002, now Pat. No. 6,658,971.

(51) Int. Cl.[7] ..... B25B 7/12
(52) U.S. Cl. ..... 81/405; 81/355
(58) Field of Search ..... 81/355, 361–363, 81/367, 372–377, 381, 383, 383.5, 385, 405, 90.1, 90.2, 90.9, 91.1, 106, 117, 128

(56) References Cited

U.S. PATENT DOCUMENTS

| | | | | |
|---|---|---|---|---|
| 1,508,510 A | | 9/1924 | Edwards | |
| 2,827,814 A | | 3/1958 | Israel | |
| 3,496,808 A | * | 2/1970 | Schmidt | 81/370 |
| 3,600,986 A | | 8/1971 | Baldwin, Jr. | |
| 5,101,944 A | | 4/1992 | Kawai | |
| 5,385,072 A | | 1/1995 | Neff | |
| 5,735,353 A | | 4/1998 | Undin | |
| 6,014,917 A | | 1/2000 | Bally et al. | |
| 6,065,376 A | | 5/2000 | Khachatoorian | |
| 6,212,978 B1 | | 4/2001 | Seber et al. | |
| 6,279,431 B1 | | 8/2001 | Seber et al. | |

* cited by examiner

*Primary Examiner*—David B. Thomas
(74) *Attorney, Agent, or Firm*—David C. Jenkins; Eckert Seamans Cherin & Mellott, LLC

(57) ABSTRACT

A hand tool having a first hand tool member assembly having a jaw portion, a tension assembly, and a cam assembly and a second hand tool member assembly having a jaw portion. The hand tool further has a jaw portion first pivot point coupling the first hand tool member assembly to the second hand tool member assembly and a jaw portion second pivot point coupling the first hand tool member assembly to the second member assembly. The jaw portion second pivot point located closer to the first member and second member jaw portions than the jaw portion first pivot point. The first hand tool member assembly jaw portion and the second hand tool member assembly jaw portion are structured to close together in a three-phase motion consisting of a first pivot phase, a transition phase and a second pivot phase, the first hand tool member assembly jaw portion and the second hand tool member assembly jaw portion pivot relative to each other about the jaw portion first pivot point during the first pivot phase and pivot relative to each other about the jaw portion second pivot point during the second pivot phase. The cam assembly is structured to engage the tension assembly when the first hand tool member assembly jaw portion and the second hand tool member assembly jaw portion contact a workpiece thereby initiating the transition phase between the first pivot phase and the second pivot phase wherein the rotation about the jaw portion first pivot point is halted causing the jaw portions to rotate about the jaw portion second pivot point.

37 Claims, 27 Drawing Sheets

SELF-ADJUSTING HAND TOOLS UTILIZING A CAM

CROSS REFERENCE TO RELATED APPLICATION

This application is a continuation-in-part of U.S. application Ser. No. 10/068,375, filed Feb. 5, 2002, now U.S. Pat. No. 6,658,971 issued Dec. 9th, 2003 which is incorporated herein by reference.

BACKGROUND OF THE INVENTION

1. Field of the Invention

This invention relates to self-adjusting pliers having jaws which pivot about a jaw portion first pivot point during a first phase and a jaw portion second pivot point during the second closing phase and, more specifically, to a pair of pliers which utilizes a cam during the transition between the first phase of operation and the second phase of operation.

2. Background Information

Pliers are used to grasp or otherwise act upon a workpiece. A pair of pliers includes two elongated members joined by a pivot pin at an intersection on the medial portion of the members. One end of each elongated member forms a jaw and the other end of the elongated members forms a handle. A workpiece located between the jaws may be grasped by an operator drawing the handle portions towards each other. Hand tools have also been constructed using two elongated members which do not intersect, but which are joined by a link member, see, e.g., U.S. Pat. No. 3,600,986. The link member forms a toggle joint with one of the handle portions. The toggle joint augments to force applied by the user as the angle of toggle joint approaches 180 degrees.

The basic pair of pliers was improved to be self-adjusting by incorporating a slot in one elongated member which allows the jaw portion of the other elongated member to be moved relative to the pivot point, see, e.g., U.S. Pat. No. 1,508,510. Further improvements to pliers allow the pliers to self-adjust to the size of the workpiece and further incorporate a two pivot system, see, e.g. U.S. Pat. No. 6,014,917. The two pivot system provides for a first pivot point that allows the jaw members to close until contacting a workpiece whereupon the pivot point shifts to the second pivot point, which is typically located closer to the workpiece, thereby giving the user greater leverage while drawing the handle portions towards each other. The second pivot point is typically created by a pawl which engages a toothed rack. During the initial phase of operation, the pawl is spaced apart from the rack, or allowed to slide over the rack. When the jaws of the pliers contact the workpiece, the pawl is shifted into engagement with the rack thereby creating the second pivot point.

The disadvantage of pliers which utilize a pawl to form the second pivot point is that such pliers are subject to a periodic force variation as the pawl engages the rack. That is, because the teeth on the rack are disposed at fixed incremental locations and because the pawl moves over the rack teeth, the pawl may not be positioned to engage a tooth on the rack at the point when the jaws of the pliers contact the workpiece. When this occurs, the pawl must move backwards on the rack to engage a tooth. The larger the tooth, the more variation there is between the point at which the jaws contact the workpiece and the point at which the second pivot is created. One method of reducing the variation is to utilize racks having smaller teeth. Smaller teeth, however, are weaker and may not be able to tolerate the stress placed on the tooth. Additionally, fine teeth are difficult to manufacture and are subject to degradation from repeated use.

Further, prior art pliers have not successfully combined the self-adjusting and force augmenting features with a locking feature. For example, a typical toggle joint tool utilizes an over-toggle pin to lock the tool. An over-toggle pin, however, requires that the toggle joint pass through the toggle position to engage. After the toggle joint passes through the toggle position, the closing force is reduced.

There is, therefore, a need for a pair of pliers that operate about a first pivot during a first pivot phase and about a second pivot during a second pivot phase and which does not utilize a pawl and tooth rack combination to create the second pivot.

There is a further need for a pair of pliers that operate about a first pivot and a second pivot which does not have a variation during the transition between the first pivot and the second pivot.

There is a further need for a pair of pliers that incorporates a self-adjusting mechanism, a force augmentation mechanism and a locking mechanism.

SUMMARY OF THE INVENTION

These needs, and others, are satisfied by the present invention which provides a pair of pliers having two opposed members, a first plier member assembly and a second plier member assembly which are joined at a jaw portion first pivot point. The pliers further include a jaw portion second pivot point, located closer to the jaws of the pliers than the first pivot point. The pliers further include a cam assembly and a tension assembly. The pliers member assemblies pivot about the first pivot point during a first pivot phase of operation. When the jaws of the pliers contact a workpiece, the pliers enter a transition phase wherein the cam assembly engages the tension assembly. After the tension assembly is engaged, the jaws pivot about the jaw portion second pivot point. That is, at the end of the transition phase the cam is fully engaged against the tension assembly thereby resisting further movement along the tension assembly. Because the first link is not free to rotate about the first pivot point, the jaws of the pliers rotate about the second pivot point.

The pliers include a rigid first plier member assembly having a jaw portion, an intermediate portion, and a handle portion. The first plier member assembly further includes a first link which is coupled at one end to the handle portion of the first plier member assembly and which has a distal end having an end plate upon which the cam assembly and a jaw portion second pivot pin are disposed. The first plier member assembly further includes a tension bar having an elongated member which extends between the second phase pivot pin and the rotating cam. The first plier member assembly handle portion includes a first link pivot point and a jaw portion first pivot point. The pliers also have a second plier member assembly which includes a movable member with a jaw portion and an intermediate portion, a handle member, and a second link. The second plier member assembly handle member is pivotally attached to the second plier member assembly moving member. The second plier member assembly moving member further includes an opening on the intermediate portion for the second phase pivot pin.

A second link is rotatedly coupled to the second plier member assembly handle member at a toggle pivot point and form a toggle joint. The second link is also rotatably coupled to the first plier member assembly handle portion at the jaw portion first pivot point. A first phase pivot pin couples the second link to the first plier member assembly handle portion. Thus, the second plier member assembly jaw portion is coupled to both the first link and the second link. Both the first link and the second link are coupled to the first plier member assembly handle portion. Thus, when the distance between the pivot points on the second plier member assembly movable member and the pivot points on the first plier member assembly handle portion are about the same, the four pivot points form a parallelogram. In this configuration, the motion of the second plier member assembly jaw portion relative to the first plier member assembly jaw portion can be controlled so that the jaws move parallel to each other during the first phase (described below).

The second plier member assembly handle member also interacts with a cam in the cam assembly, holding the cam out of contact with the tension bar during the first phase rotation, and allowing the cam to engage the tension bar assembly during the intermediate phase and the second phase. A cam spring causes the cam to engage the tension bar.

The pliers operate in three phases. At the initial starting point, the plier jaw portions are separated and a workpiece is disposed therebetween. During the first pivot phase of operation the first plier member assembly and the second plier member assembly pivot about the jaw portion first phase pivot pin. When the jaw portions contact the workpiece, the pliers enter an intermediate phase wherein rotation about the first phase pivot pin ceases and rotation about the toggle pivot point begins. As the second plier member assembly handle member rotates relative to the second link, the second plier member assembly handle member releases the cam assembly causing the cam assembly to engage the tension bar assembly. When the cam assembly has engaged the tension bar assembly, rotation between the first link and the first plier member assembly handle portion ceases, thereby ending the transition phase and begins the second pivot phase. During the second pivot phase the second plier member assembly toggle joint is moved toward, or even through, the toggle position. As the second plier member assembly toggle joint moves toward the toggle position, the second plier member assembly movable member pivots about the jaw portion second phase pivot pin. The jaw portion second phase pivot pin is located substantially closer to the workpiece than the jaw portion first phase pivot pin. Because the transition phase relies on a cam assembly acting against a tension assembly, the pliers do not slip backwards as would a tool utilizing a pawl and tooth rack system.

Additionally, the nature of the toggle joint provides the force augmentation mechanism whereby the force applied by the user is enhanced. That is, during the second phase as the toggle angle approaches 180 degrees, the theoretical force approaches infinity. Due to frictional forces, infinite force is not reached, but the closing force is still higher than the force applied by the user.

The pliers may also have a mechanical locking assembly. The locking assembly is, preferably, disposed at the toggle joint. The locking assembly may be a pawl and toothed rack device having the pawl attached to one member of the toggle joint and the rack attached to the other member of the toggle joint. As the toggle joint opens, the pawl engages the rack. At the end of the second phase, the pawl has engaged the rack thereby locking the toggle joint in place.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
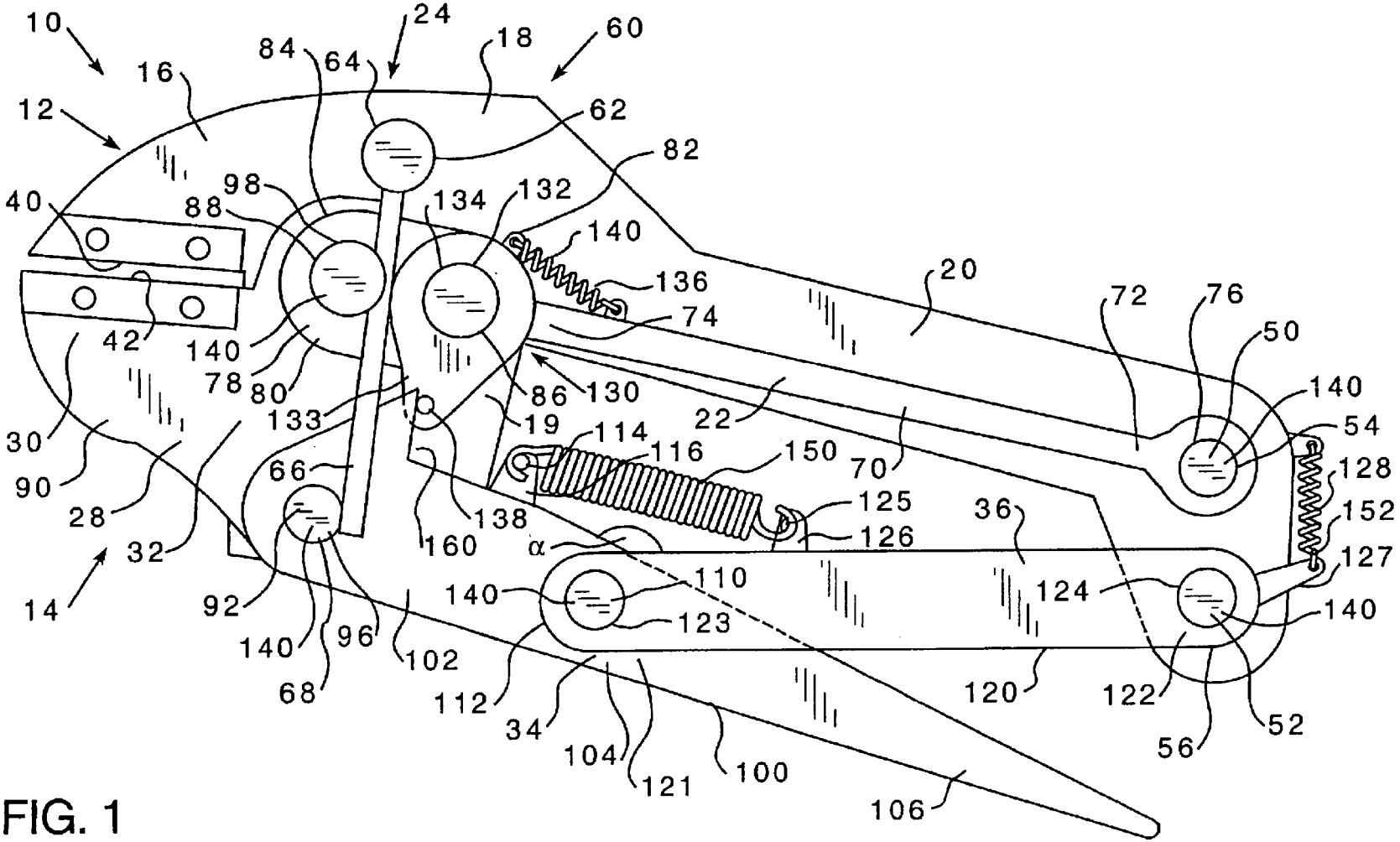
FIG. 1 is a cross-sectional view of a first embodiment of the pliers.
Figure 2:
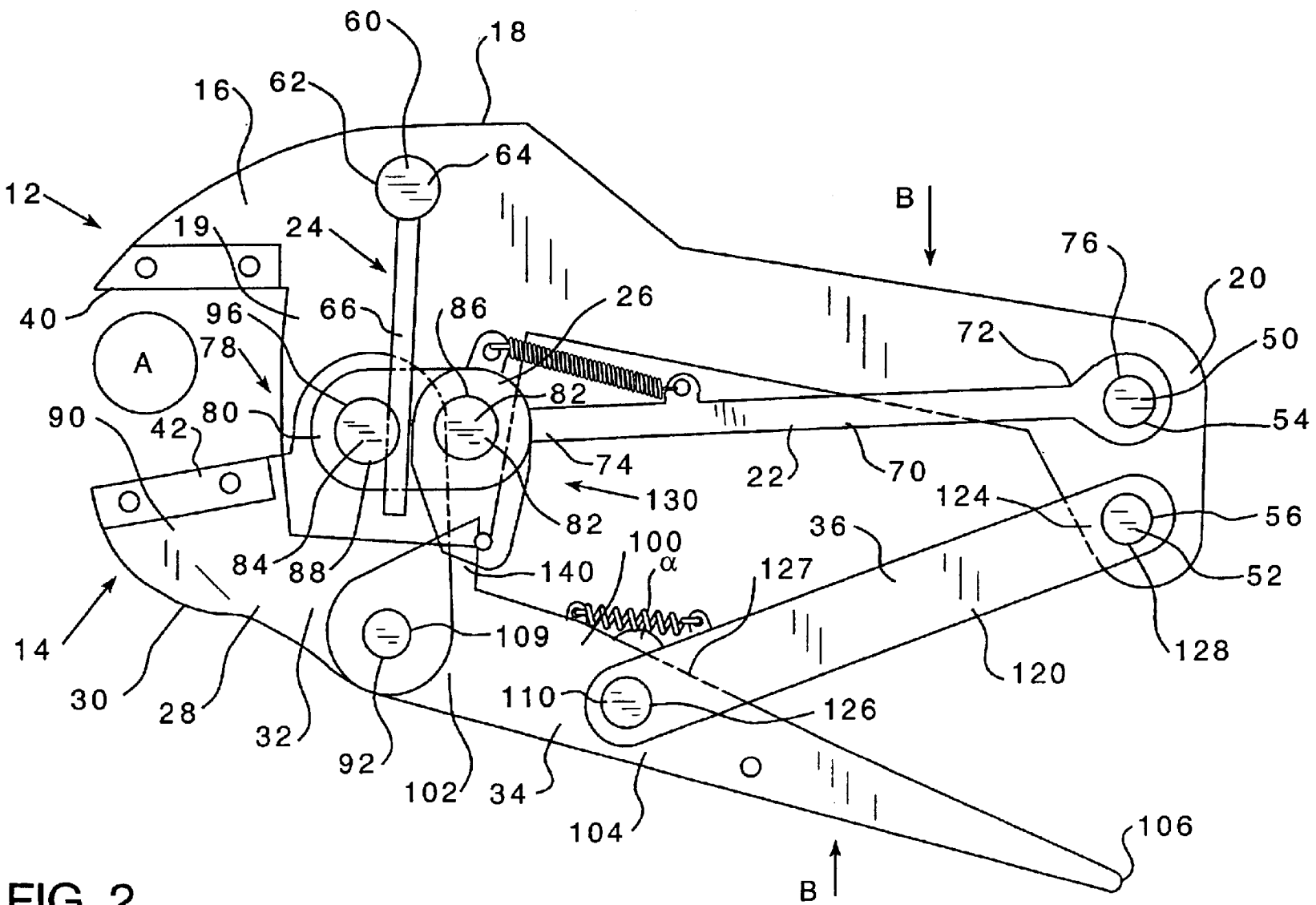
FIG. 2 shows the first embodiment of the pliers at the beginning of the first phase of operation.

As shown in FIGS. 1-5, a pair of pliers 10 includes first plier member assembly 12 and second plier member assembly 14. The first plier member assembly 12 is rigid and has a jaw portion 16, an intermediate portion 18, an elongated handle portion 20, a first link 22, a tension assembly 24, and a cam assembly 130 (described below). The second plier member assembly 14 is non-rigid having a movable member 28, which includes a jaw portion 30, an intermediate portion 32, and an elongated handle member 34, and a second link 36. The first and second member assemblies 12, 14 do not intersect each other. That is, the first plier member assembly jaw portion 16 and the first plier member assembly handle portion 20 are disposed on the same side of the first and second jaw portion pivot points 52, 84 (described below).

As used herein, the "plane of the tool" indicates the plane that extends through the axis of the first plier member assembly 12 and the second plier member assembly handle member 34. As will be described below, there are a plurality of pivot points located on the first plier member assembly 12 and the second plier member assembly 14, or coupling the first plier member assembly 12 and the second plier member assembly 14 together. The pivot points include a pivot point opening located on either the first plier member assembly 12 or the second plier member assembly 14 and a pivot rod 140. Each pivot rod 140 extends in a direction generally perpendicular to the plane of the tool. It is further understood that, while openings working with separate pivot rods 140 are one easy method of constructing the pliers, the pivot points could also be formed of rods which are integral with the first plier member assembly 12 and/or the second plier member assembly 14.

The first plier member assembly jaw portion 16 includes a first closing surface 40 that is structured to engage a workpiece "A." Adjacent to, and integral with, the first plier member assembly jaw portion 16 is the first plier member assembly intermediate portion 18. The first plier member assembly intermediate portion 18 includes a side plate 19 that extends toward the second plier member assembly 14 in a direction generally perpendicular to the first closing surface 40. Adjacent to, and integral with, the first plier member assembly intermediate portion 18 is the first plier member assembly elongated handle portion 20. At the distal end of the first plier member assembly handle portion 20 are two pivot points, a first link pivot point 50 and jaw portion first pivot point 52. The first link pivot point 50 and the jaw portion first pivot point 52 each include an opening on the first plier member assembly handle portion; a first link pivot point opening 54 and a jaw portion first pivot point opening 56. The first plier member assembly handle portion 20 also includes an opening spring attachment point 58. The opening spring attachment point 58 is typically an opening that may be coupled to an opening spring 152 (described below). The first plier member assembly handle portion opening spring attachment point 58 may be located on an extension 59 that allows the opening spring attachment point 58 to be spaced from the jaw portion first pivot point opening 56.

Figure 6:
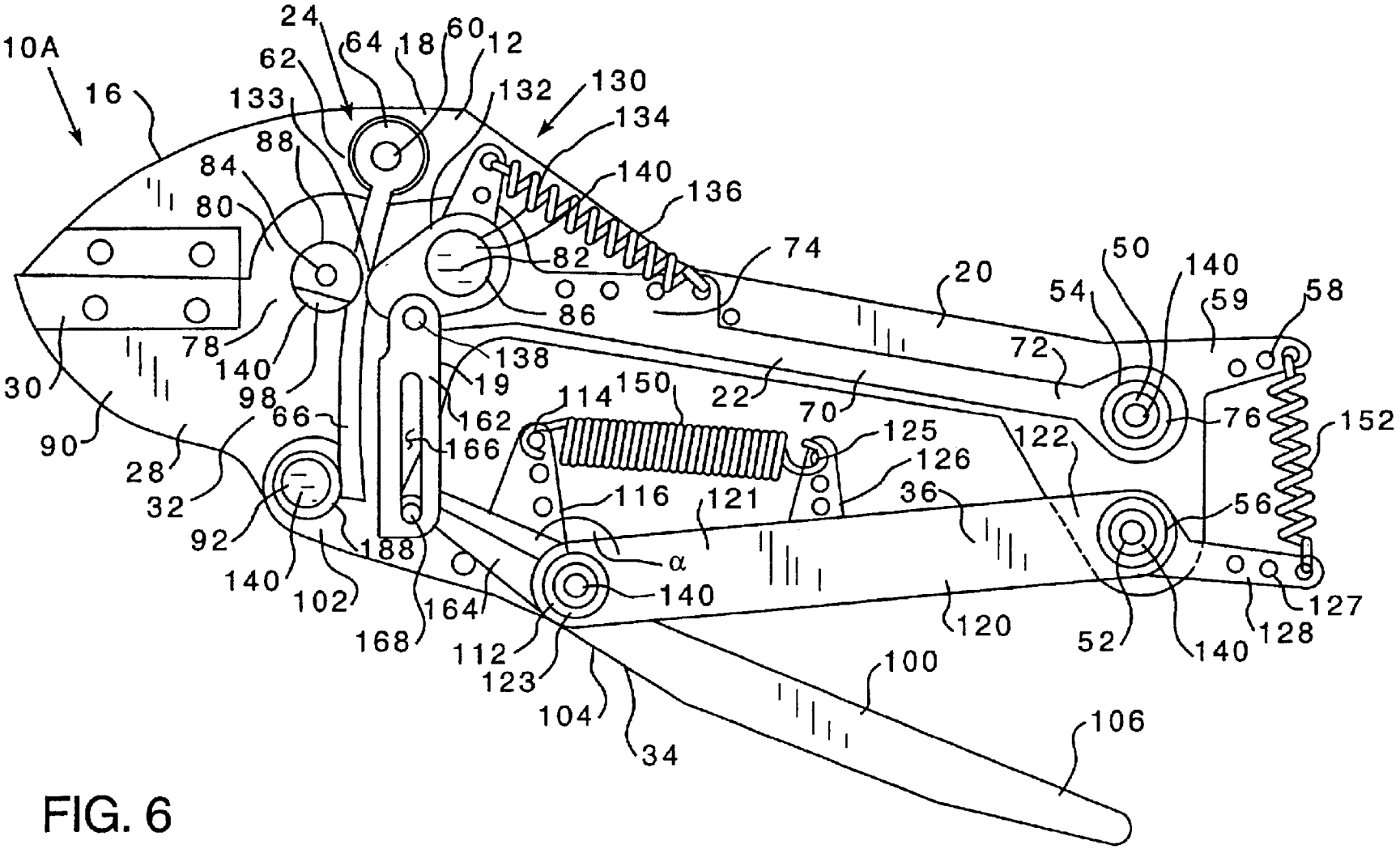
FIG. 6 is a cross-sectional view of a second embodiment of the pliers.
Figure 7:
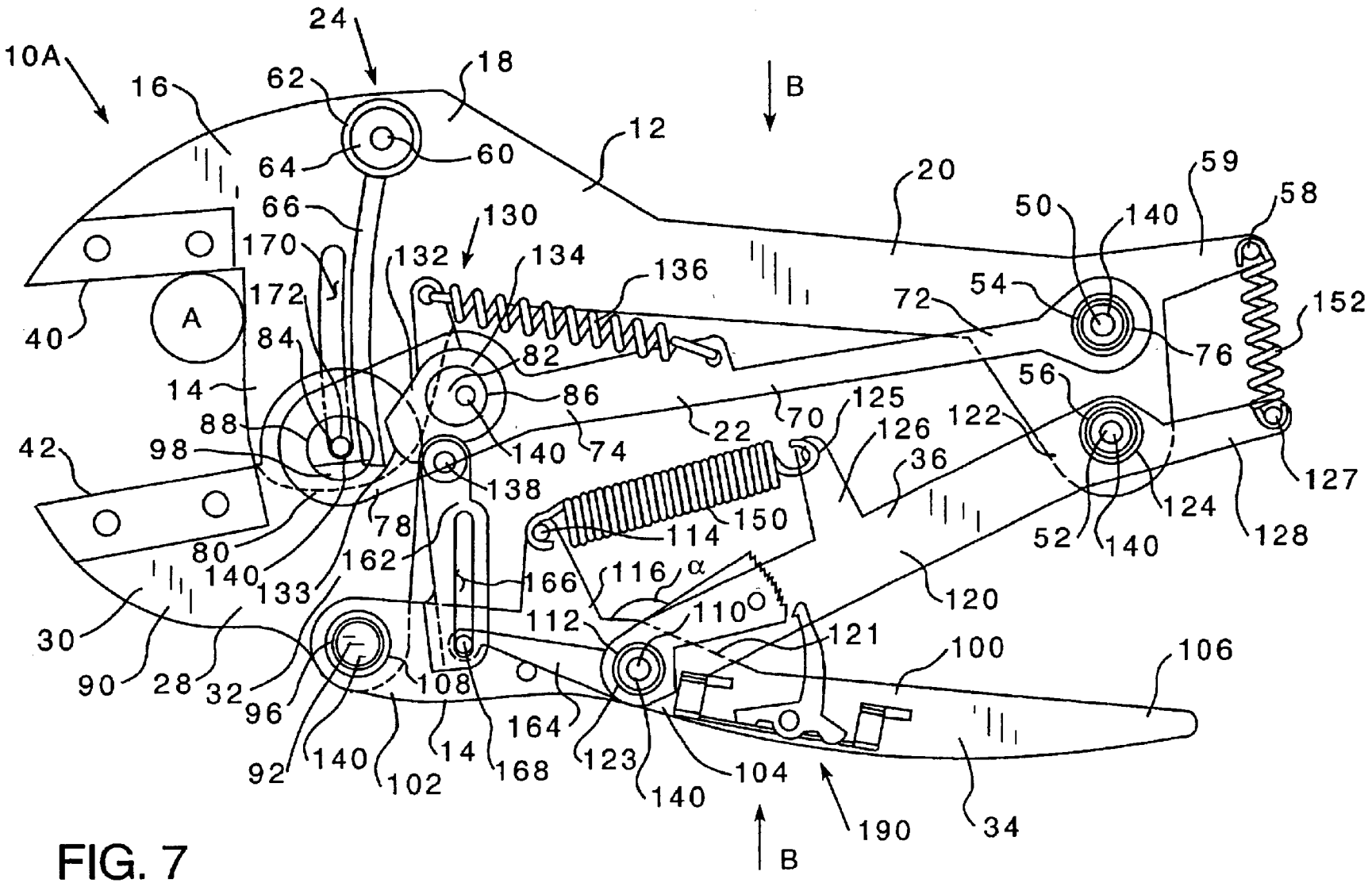
FIG. 7 shows the second embodiment of the pliers at the beginning of the first phase of operation.
Figure 8:
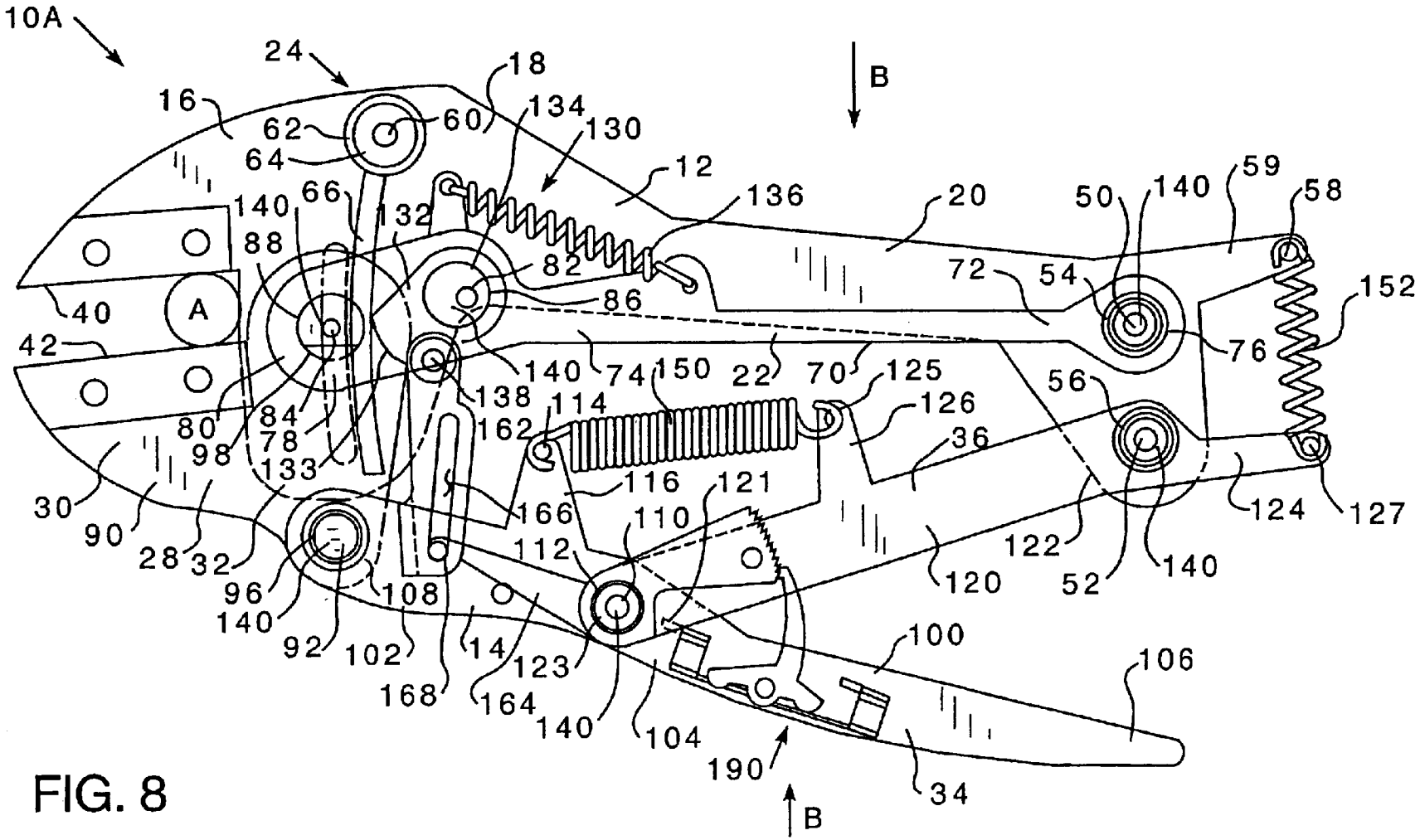
FIG. 8 shows the second embodiment of the pliers at the beginning of the transition phase.
Figure 9:
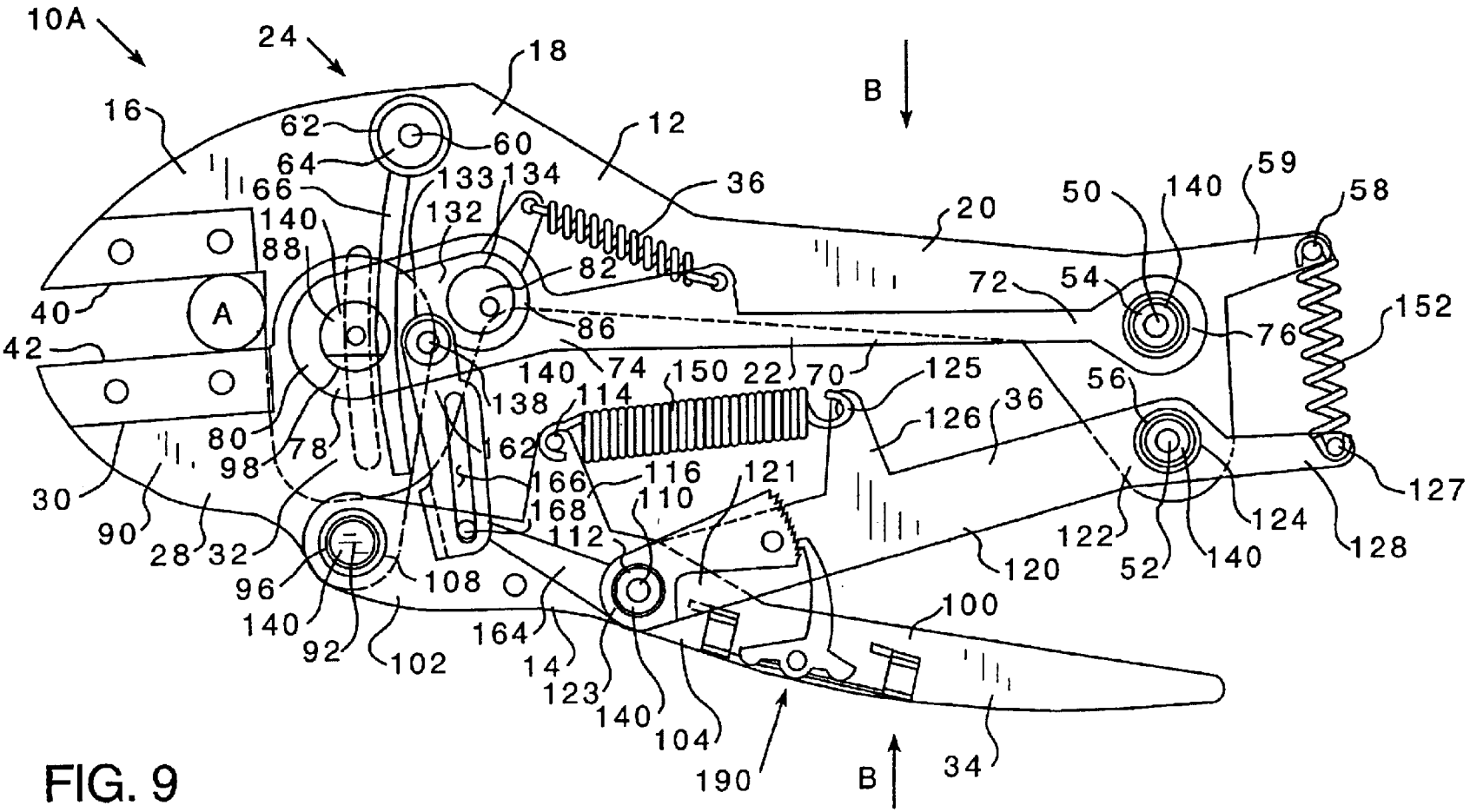
FIG. 9 shows the second embodiment of the pliers at the end of the transition phase.

The first plier member assembly intermediate portion 18 includes a tension assembly pivot point 60. The tension assembly pivot point includes a tension assembly pivot point opening 62 in the first plier member assembly intermediate portion 18. The first plier member assembly tension assembly 24 includes a pivot rod 64 having an elongated tension member 66 extending radially therefrom. The tension assembly pivot rod 64 is sized to fit within the tension assembly pivot point opening 62. The tension member 66 may be generally straight (FIG. 1 ) or arced (FIG. 6). If the tension member 66 is arced, preferably the radius is about the distance between the jaw portion first pivot point 52 to the tension assembly pivot rod 64.

The first link 22 includes an elongated body 70 having a first end 72 and a second end 74. A first link pivot point opening 76 is disposed at the first link body first end 72. An end plate 78 is disposed at the first link second end 74. The end plate 78 includes a generally flat, elongated member 80 and two pivot points; a cam pivot point 82 and a second plier member assembly jaw portion second pivot point 84. As before, the end plate flat member cam pivot point 82 and the second plier member assembly jaw portion second pivot point 84 each includes an opening, a cam pivot point opening 86 and a jaw portion second pivot point opening 88. The jaw portion second pivot point opening 88 is disposed adjacent to the distal end of the end plate flat member 80 and the cam pivot point opening 86 is disposed adjacent to the first link body 70. The jaw portion second pivot point opening 88, the cam pivot point opening 86 and the first link pivot point opening 76 are, preferably, disposed linearly.

The first plier member assembly 12 further includes a cam assembly 130. The cam assembly 130 includes a cam member 132 having a cam surface 133 and a cam pivot point opening 134, a cam spring 136 and a cam release device, such as a cam release pin 138 or a release link 139, structured to release the cam as described below.

The second plier member assembly movable member 28 includes a generally flat body 90 shaped to form the second plier member assembly jaw portion 30 and the second plier member assembly intermediate portion 32. The second plier member assembly jaw portion includes a second closing surface 42 that is structured to engage workpiece A. The second plier member assembly intermediate portion 32 includes two pivot points; a handle member pivot point 92 and a second plier member jaw portion second pivot point 84. The handle member pivot point 92 includes a handle member pivot point opening 96. The second plier member assembly jaw portion second pivot point 84 includes a jaw portion second pivot point opening 98.

The second plier member assembly handle member 34 includes an elongated body 100 having a first end 102, a medial portion 104, and a second end 106. The second plier member assembly handle member medial portion 104 is disposed between the second plier member assembly handle member first end 102 and the second plier member assembly handle member second end 106. The second plier member assembly handle member first end 102 includes a handle member pivot point opening 108. A toggle pivot point 110 is located on the second plier member assembly handle member medial portion 104. The toggle pivot point 110 includes a toggle pivot point opening 112. Between the second plier member assembly handle member first end handle pivot point opening 108 and the second plier member assembly handle member toggle pivot point opening 112 is a toggle spring attachment point 114. The handle member toggle spring attachment point 114 is typically an opening that may be coupled to a toggle spring 150 (described below). The handle member toggle spring attachment point 114 may be disposed on an extension 116 that allows the handle member toggle spring attachment point 114 to be spaced from the toggle pivot point 110.

The second plier member assembly second link member 36 includes a generally flat, elongated body 120 having a first end 121 and a second end 122. The second link first end 121 includes a toggle pivot point opening 123. The second link second end 122 includes a jaw portion first pivot point opening 124. Adjacent to the second link first end 121 is a is a toggle spring attachment point 125. The second link member toggle spring attachment point 125 is typically an opening that may be coupled to a toggle spring 150 (described below). The second link toggle spring attachment point 125 may be disposed on an extension 126 that allows the second link toggle spring attachment point 125 to be spaced from the toggle pivot point 110. Adjacent to the second link second end 122 is an opening spring attachment point 127. The second link member opening spring attachment point 127 is typically an opening that may be coupled to an opening spring 152 (described below). The second link member opening spring attachment point 127 may be disposed on an extension 128 that allows the second link member opening spring attachment point 127 to be spaced from the jaw portion first pivot point 52.

Using a plurality of pivot rods 140 that extend generally perpendicular to the plane of the tool, the pliers 10 are assembled as follows. The tension assembly pivot rod 64 is pivotally disposed in the first plier member assembly intermediate portion tension assembly pivot point opening 62. The elongated tension member 66 extends toward the distal end of the first plier member assembly intermediate portion side plate 19. The first link first end 72 is pivotally coupled to the first plier member assembly handle portion 20 at the first link pivot point 50 by a pivot rod 140 passing through the first plier member assembly handle portion first link pivot point opening 54 and through the first link first link pivot point opening 76. The second link member 36 is pivotally coupled to the first plier member assembly handle portion 20 by a pivot rod 140 passing through the first plier member assembly handle portion jaw portion first pivot point opening 56 and through the second link jaw portion first pivot point opening 124. The second plier member assembly second link member 36 is further coupled to the second plier member assembly handle member 34 at the toggle pivot point 110 by a pivot rod 140 passing through the second link toggle pivot point opening 123 and through the second plier member assembly handle member toggle pivot point opening 112.

The second plier member assembly handle member 34 is pivotally coupled to the second plier member assembly movable member 28 at the second plier member assembly handle member pivot point 92 by a pivot rod 140 passing through the second plier member assembly handle member first end handle pivot point opening 108 and the second plier member assembly moving member handle member pivot point opening 96. The second plier member assembly movable member 28 is further coupled to the first link 22 at the second plier member assembly jaw portion second pivot point 84 by a pivot rod 140 passing through the second plier member assembly moving member jaw portion second pivot point opening 98 and through the first plier member assembly first link jaw portion second pivot point opening 88. Additionally, the cam member 132 is pivotally coupled to the first link end plate flat member 80 at the cam pivot point 82 by passing a rod 140 through the cam member cam pivot point opening 134 and through the first link cam pivot point opening 86.

A toggle spring 150 is coupled to the second plier member assembly handle member 34 and to the second link member 36. The toggle spring 150 is, preferably, a tension spring that extends between the second plier member assembly handle member toggle spring attachment point 114 and the second link toggle spring attachment point 125. The toggle spring creates a greater biasing force than the cam spring 136. An opening spring 152 extends between the first plier member assembly handle portion and the second plier member assembly second link member 36. The opening spring 152 extends between the first plier member assembly handle portion opening spring attachment point 58 and the second link opening spring attachment point 127. The opening spring 152 is preferably a tension spring.

The tension assembly tension member 66 is disposed between the pivot rod 140 located at the second plier member assembly jaw portion second pivot point 84 and the cam member 132. The cam member 132 is structured to pivot about the cam pivot point opening 134 between two positions; a first, non-engaging position and a second, tension bar engaging position. The cam member spring 136 is, preferably, tension spring coupled to the cam member 132 and to the first link body 70. The cam spring 136 is structured to rotate the cam member 132 about the cam pivot point opening 134 until the cam surface 133 of the cam member 132 engages the tension assembly tension member 66. That is, the cam spring 136 is structured to move the cam member 132 into the second position. The cam member 132 is maintained in the first position by the cam release device described below.

The cam assembly release device is structured to counteract the force applied by the cam spring 136 and thereby keep the cam member 132 from engaging tension member. There are two embodiments of pliers 10, 10A shown in FIGS. 1-5 and 6-10. Each embodiment shows one release device. The cam release device includes the cam release pin 138 that is coupled to the cam member 132 and a release structure that acts on the cam release pin 138. The release structure is incorporated into the second plier member assembly 14. As shown in FIGS. 1-5, the release structure may be a release tab 160 extending from the second plier member assembly handle member 34 and structured to contact the release pin 138 during the first phase of operation (described below). Alternatively, as shown in FIGS. 6-10, the release structure may be a tension link 162 coupled to a release extension 164 on the second link 36. The tension link 162 is an elongated member having an axial slot 166. The second link release extension 164 extends from the second link first end 121 beyond the toggle pivot point opening 123. The second link release extension 164 includes a tension link pin 168 disposed in the tension link slot 166. The tension link 162 is also pivotally coupled to the release pin.

Figure 3:
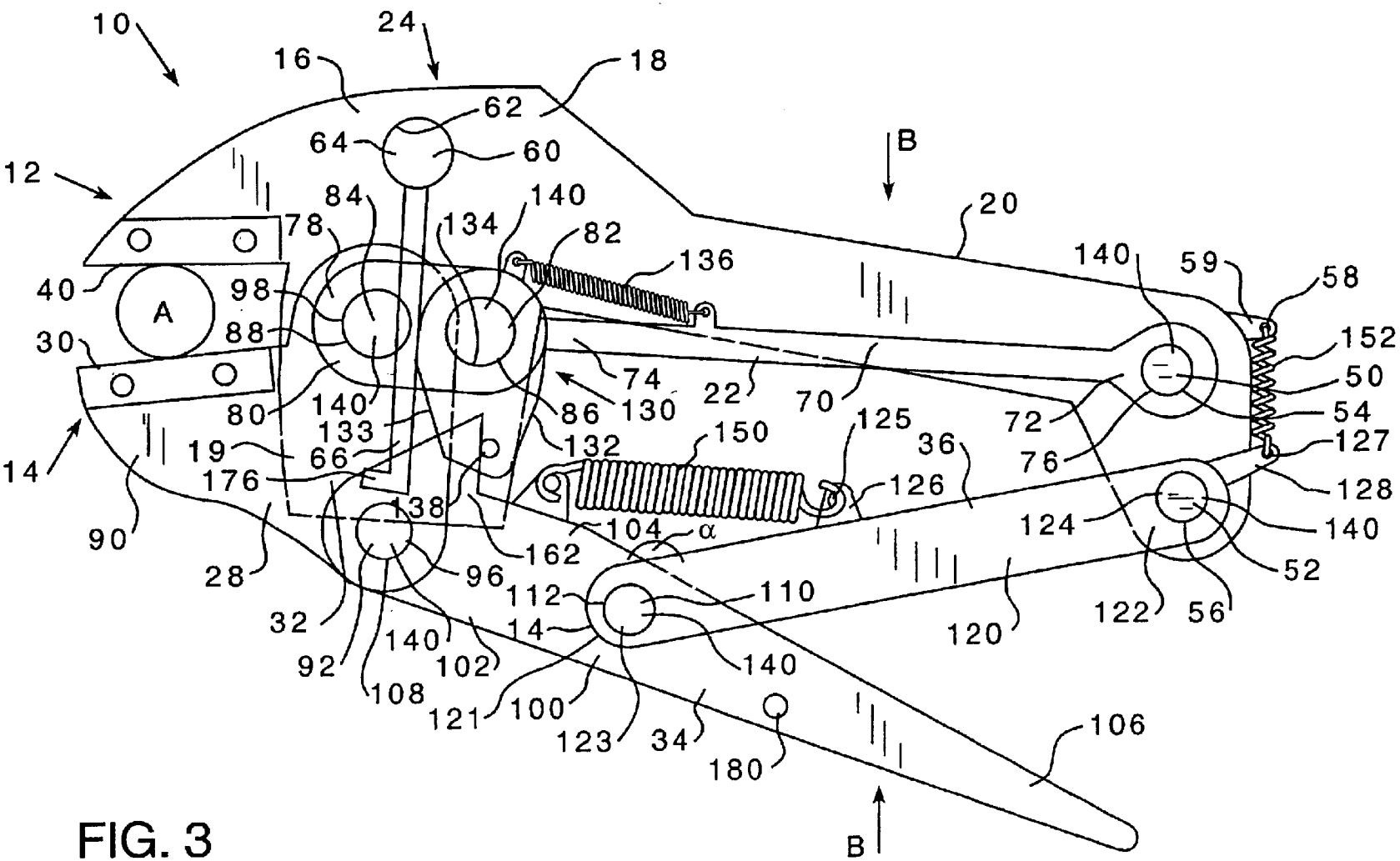
FIG. 3 shows the first embodiment of the pliers at the beginning of the transition phase and having an alternate tension member.
Figure 4:
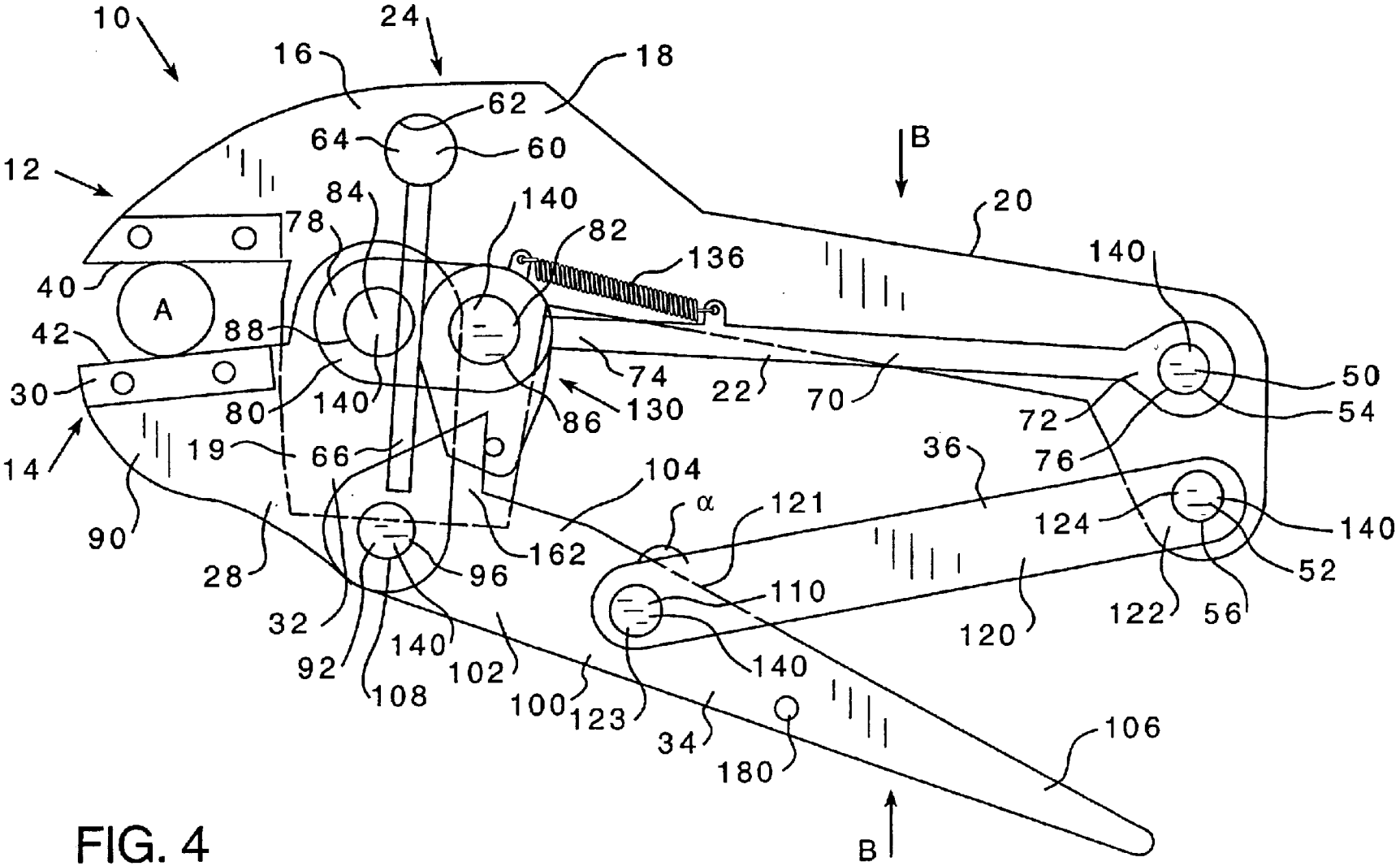
FIG. 4 shows the first embodiment of the pliers at the end of the transition phase.

The pliers 10 further includes a stop means to prevent the first plier member assembly 12 and the second plier member assembly 14 from opening too widely. The stop means may be any known means, such a slot 170 (FIG. 7) located on the first plier member assembly intermediate portion 18 and a stop pin 172 (FIG. 7) extending from the pivot rod 140 located at the second plier member assembly jaw portion second pivot point 84. Alternatively, as shown in FIG. 3, the stop means may be a perpendicular tab 176 located at the distal end of the tension member 66.

As shown in FIGS. 2-5, the pliers 10 may also be equipped with an over-toggle stop pin 180. As detailed below, the second plier member assembly handle member 34 and the second plier member assembly second link member 36 are pivotably coupled at the toggle pivot point 110. Prior to use, the second plier member assembly handle member 34 and the second link member 36 are maintained at an initial toggle angle. As the first plier member assembly handle portion 20 and the second plier member assembly handle member 34 are compressed, the toggle angle becomes more obtuse. The degree of the initial toggle angle is determined by the distance between the handle member pivot point 92 and the toggle pivot point 110 and the distance between the jaw portion first pivot point 52 and the toggle pivot point 110. Typically, the initial toggle angle is between about 177 and 150 degrees. Generally, the longer the distance between the handle member pivot point 92 and the toggle pivot point 110 and the distance between the jaw portion first pivot point 52 and the toggle pivot point 110, the more acute the toggle initial angle will be. However, the pliers 10 may be constructed so that initial toggle angle is close to 180 degrees. In this construction, applying force to the first plier member assembly handle portion 20 and the second plier member assembly handle member 34 cause the second plier member assembly handle member 34 and the second link member 36 to move so that the toggle angle is 180 degrees and then into an over-toggle position. In the over-toggle position, the toggle angle between the second plier member assembly handle member and the second link member is about 181 degrees. Rotation between the second plier member assembly handle member 34 and the second link member 36 in the over-toggle position is stopped by a stop pin 180. When the second plier member assembly handle member 34 and the second link member 36 are in the over toggle position the pliers 10 are locked into position and the user does not need to apply hand pressure to hold the jaw portions 16, 30 against the workpiece A.

Figure 10:
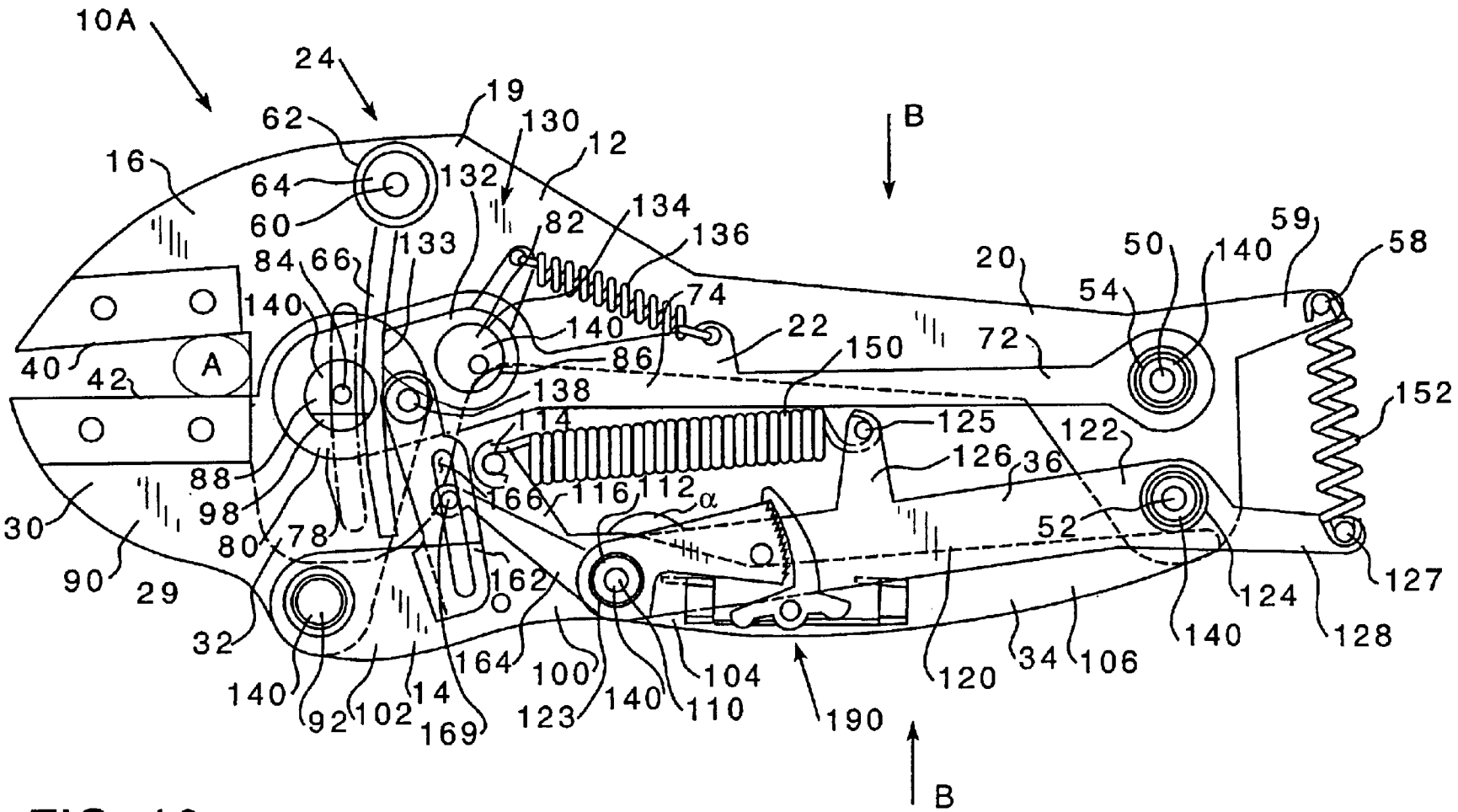
FIG. 10 shows the second embodiment of the pliers during the second phase of operation.
Figure 11:
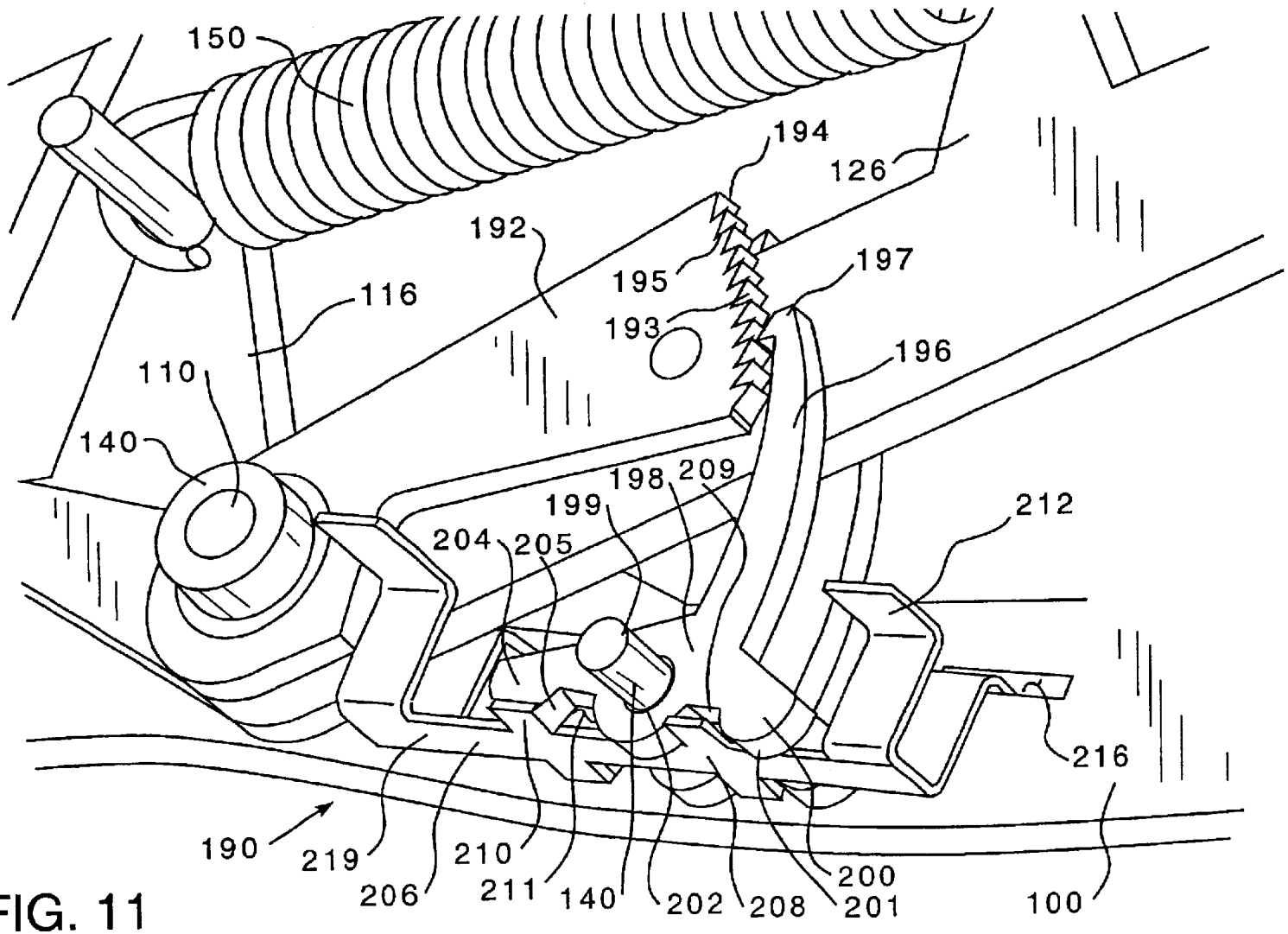
FIG. 11 is a detail cross-sectional isometric view of the locking assembly in the disengaged position.
Figure 12:
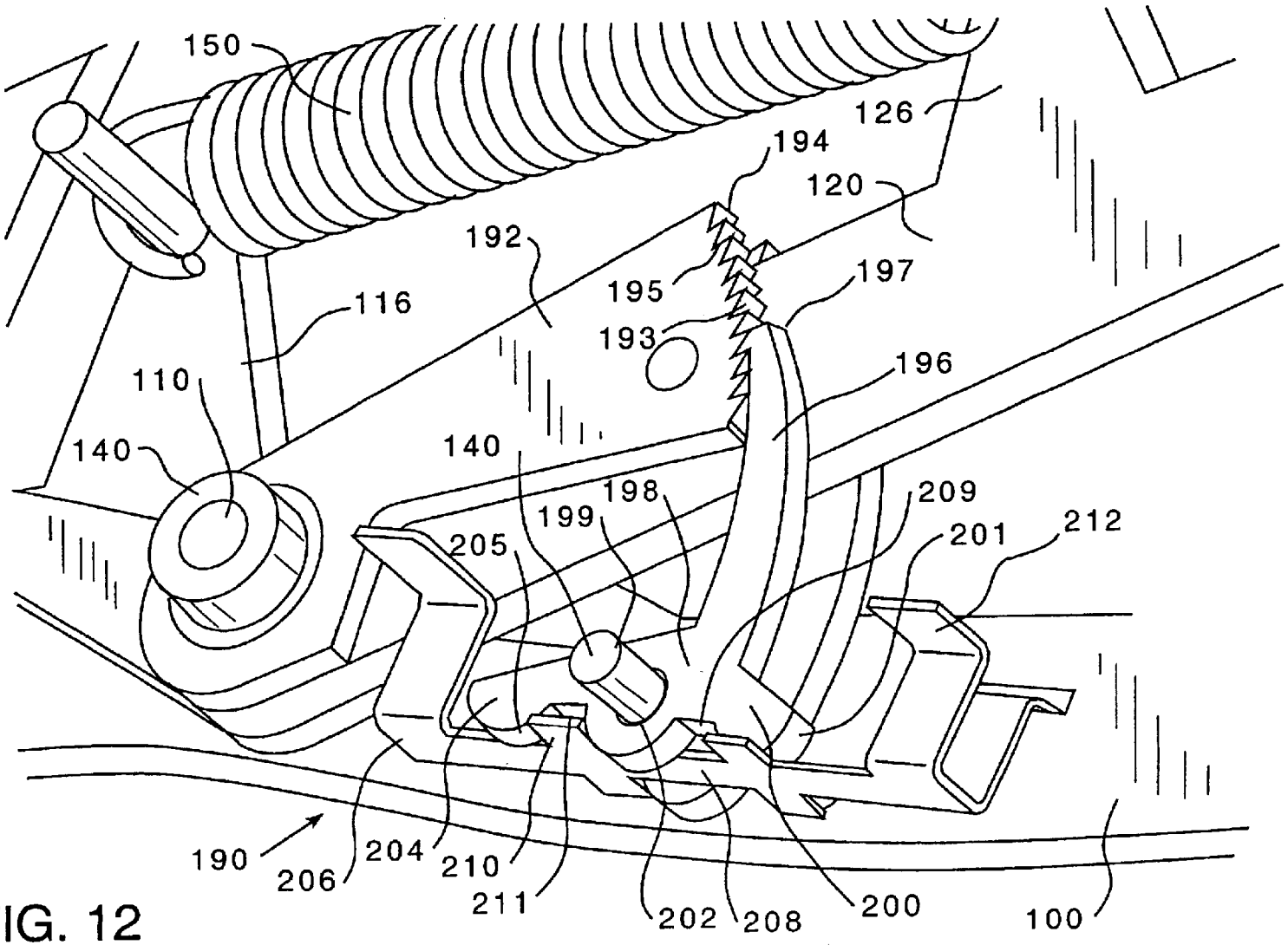
FIG. 12 is a detail cross-sectional isometric view of the locking assembly in the disengaged position.

Additionally, the pliers 10 may have a locking assembly 190 as shown in FIGS. 7-10 and detailed in FIGS. 11 and 12. The locking assembly 190 includes a rack 192 having a plurality of teeth 194, a pawl 196 having an engagement tooth 197 and a pawl base 198 with an engagement tab 200, a pivot opening 202, and a disengagement tab 204, and a lug assembly 206 having a plurality of extensions including at least one engagement extension 208, disengagement extension 210 and handle extension 212. The rack teeth 194 have an angled side 193 and a latching surface 195. The pawl tooth 197 is structured to slide over the rack teeth angled side 193 and latch against the rack teeth latching surface 195. The pawl base 198 is an elongated member extending in a direction along the second plier member assembly handle member 34. The pawl pivot opening 202 is disposed at about the middle of the pawl base 198. The pawl engagement tab 200 is located on one side of the pawl pivot opening 202. The pawl disengagement tab 204 is located on the side of the pawl pivot opening 202 opposite the pawl engagement tab 200. The pawl engagement tab 200 has an arced surface 201. The pawl disengagement tab 204 also has an arced surface 205. An engagement extension cavity 209 is disposed on the pawl base 198 between the pawl engagement tab 200 and the pawl pivot opening 202. A disengagement extension cavity 211 is disposed on the pawl base 198 between the pawl disengagement tab 204 and the pawl pivot opening 202. The lug assembly 206 includes an elongated base member 214 from which the at least one pawl engagement extension 208, disengagement extension 210 and handle extension 212 extend. The lug assembly base member 214 extends in a direction, and is structured to slide in a direction, along the axis of the second plier member assembly handle member 34. Each of the pawl engagement extension 208, disengagement extension 210 and handle extension 212 extend in a direction perpendicular to the plane of the tool. The pawl engagement extension 208 and disengagement extension 210 are spaced so that if one extension, e.g. the pawl engagement extension 208, is contacting the associated tab, e.g. the pawl engagement tab 200, the other extension, e.g. the disengagement extension 210, will be disposed in the associated cavity, e.g. disengagement extension cavity 211.

The locking assembly 190 is assembled as follows. The rack 192 is coupled to the second link member 36, preferably adjacent to the second link member first end 121. The pawl 196 and the lug assembly 206 are coupled to the second plier member assembly handle member 34 adjacent to the rack 192. The pawl 196 is rotatably mounted at a pawl pivot point 199 formed by a pivot rod 140 passing through the pawl pivot opening 202. The pawl 196 is structured to move between a rack engaging position and a disengaged position. In the rack engaging position, the pawl tooth 197 contacts the rack teeth 194. In the disengaged position, the pawl tooth 197 is spaced from the rack teeth 194. The lug assembly 206 is slidably coupled to the second plier member assembly handle member 34 adjacent to pawl base 198. One or more lug assembly handle extensions 212 extend through a handle slot 216 located on the second plier member assembly handle member 34. The lug assembly 206 may slide between a first and second position. In the first position, the engagement extension 208 contacts the pawl engagement tab arced surface 201 and the disengagement extension 210 is disposed in the disengagement extension cavity 211. Conversely, in the second position, the disengagement extension 208 contacts the disengagement tab arced surface 205 and the engagement extension 208 is disposed in the engagement extension cavity 209. When the engagement extension 208 contacts the pawl engagement tab arced surface 201, the pawl 196 is biased to rotate about the pawl pivot point 199 to the rack engaging position. When the disengagement extension 210 contacts the pawl disengagement tab arced surface 205, the pawl 196 is biased to rotate about the pawl pivot point 199 to the disengaged position.

Figure 5:
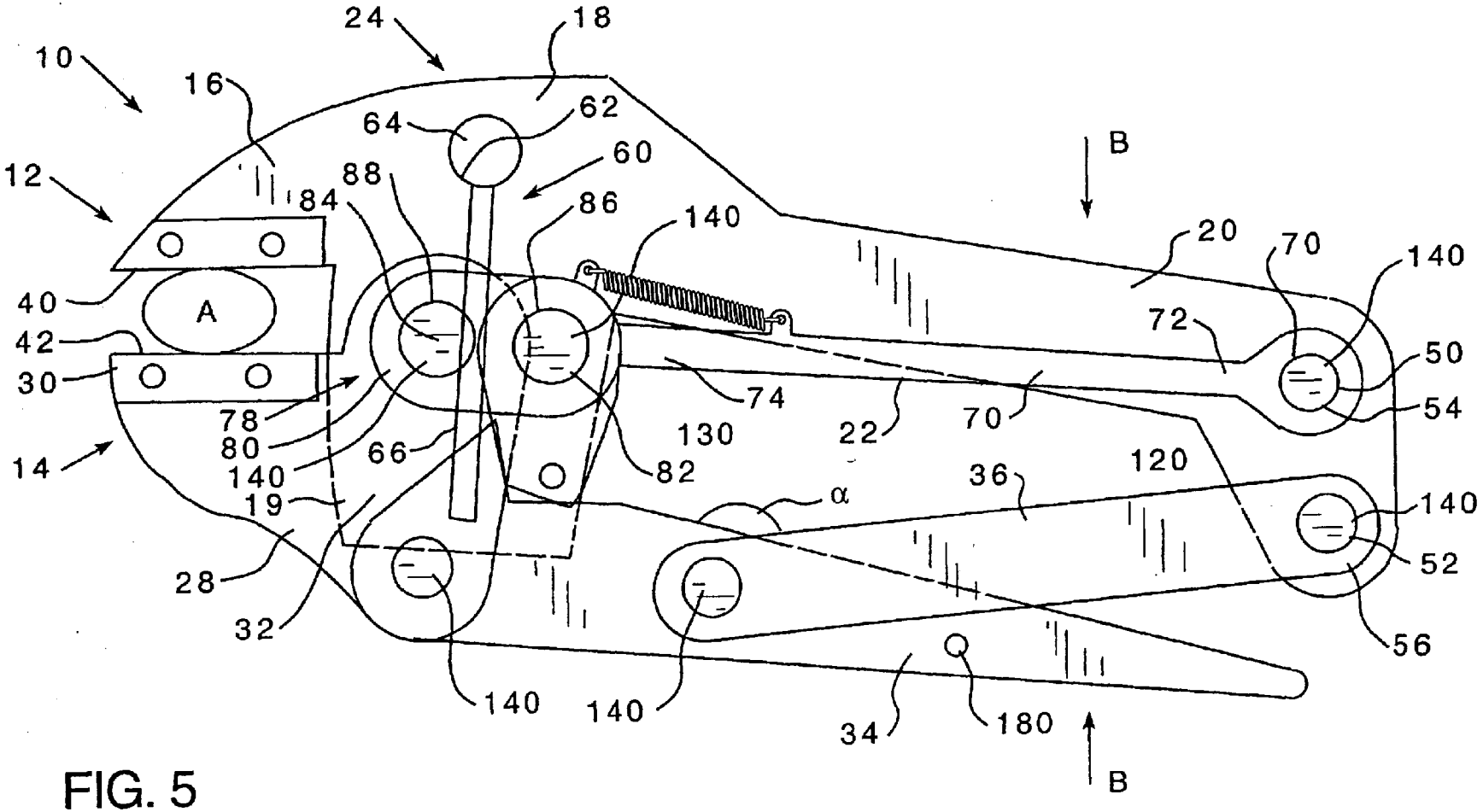
FIG. 5 shows the first embodiment of the pliers during the second phase of operation.

As shown in FIGS. 2-5 and 7-10, when assembled as described above, the pliers 10, 10A operate in a three-phase operation; a first phase wherein the second plier member assembly 14, and therefore the second plier member assembly jaw portion 30, pivot about the jaw portion first pivot point 52 (FIGS. 2 and 7), an intermediate phase wherein the cam assembly 130 engages the tension member 66 (FIGS. 3, 4, 8, 9), and a second phase wherein the second plier member assembly jaw portion 30 pivots about the second plier member assembly jaw portion second pivot point 84 (FIGS. 5 and 10). During the closing of the jaw portions 16, 30, the intermediate phase is initiated by the jaw portions 16, 30 contacting a workpiece A. Thus, the closing force on the jaw portions 16, 30 during the second phase is augmented compared to the force applied during the first phase.

For the sake of this description, the first plier member assembly 12 shall be assumed to be in a fixed location. Thus the second plier member assembly 14 shall be described as moving relative to the first plier member assembly 12. FIGS. 2-5 show the operation of a first embodiment of the pliers 10 that utilizes a release tab 160 extending from the second plier member assembly handle member 34 to actuate the cam assembly 130. In the first phase of operation, the jaw portions 16, 30 are initially separated and the cam assembly 130 has not engaged the tension member 66. The cam member 132 is maintained in a spaced relation from the tension member 66 by the second plier member assembly handle member release tab 160 contacting the cam assembly release pin 138. The second plier member assembly handle member 34 and the second plier member assembly second link 36 are held, relative to each other, at an initial toggle angle, indicated as $\alpha$, by the toggle spring 150. With the second plier member assembly handle member 34 and the second plier member assembly second link 36 maintained at a set angle, the distance between the jaw portion first pivot point 52 and the handle member pivot point 92 is also held constant. In this configuration, the second plier member assembly jaw portion 30 is coupled to both the first link 22 and the second link 36. Both the first link 22 and the second link 36 are also coupled to the first plier member assembly handle portion 20. Thus, when the distance between the handle member pivot point 92 and the jaw portion first pivot point 52, and the jaw portion second pivot point 84 and the first link pivot point 50 are about the same, the four pivot points form a parallelogram. In this configuration, the motion of the second plier member assembly jaw portion 30 relative to the first plier member assembly jaw portion 16 can be controlled so that the jaw portions 16, 30 move parallel to each other during the first phase.

When force is applied to the first plier member assembly handle portion 20 and the second plier member assembly handle member 34, as indicated by arrows "B," the second plier member assembly 14, and therefore the second plier member assembly jaw portion 30, rotate about the jaw portion first pivot point 52 and the first link rotates about the first link pivot point 50. The rotation of the second plier member assembly 14 and the first link 22 is synchronized because both are pivotably connected to the first plier member assembly handle portion 20 and joined at the second plier member assembly movable member 28. During the first phase, the second plier member assembly handle member 34 and the second plier member assembly second link 36 stay at the initial toggle angle. The first phase ends when the first plier member assembly jaw portion 16 and the second plier member assembly jaw portion 30 both contact the workpiece A.

Once the workpiece A is contacted by both jaw portions 16, 30, the transition phase begins. During the transition phase the force applied to the second plier member assembly 14 overcomes the biasing force of the toggle spring 150 causing the second plier member assembly handle member 34 to move relative to the second plier member assembly second link member 36. That is, the toggle angle becomes more obtuse. As the second plier member assembly handle member 34 pivots about the toggle pivot point 110, the second plier member assembly handle member release tab 160 is rotated away from the cam assembly release pin 138. As the second plier member assembly handle member release tab 160 rotates away from the cam assembly release pin 138, the cam spring 136 causes the cam member 132 to rotate about the cam pivot point opening 134 and brings the cam surface 133 into contact with the tension member 66. At this point, if the tension member 66 is not already contacting the pivot rod 140 located at the second plier member assembly jaw portion second pivot point 84, the tension member 66 may rotate about the tension assembly pivot point 60 until the tension member contacts the pivot rod 140 located at the second plier member assembly jaw portion second pivot point 84. Thus, the tension member 66 is contacting both the pivot rod 140 located at the second plier member assembly jaw portion second pivot point 84 and the cam member 132. Friction created by the cam surface 133 against the tension member 66 prevents the first link 22 from rotating about the first link pivot point 50. When the cam surface 133 frictionally engages the tension member 66 with a sufficient force to prevent rotation about the first link pivot point 50, the transition phase ends and the second phase begins.

During the second phase, the cam member 132 remains frictionally engaged against the tension member 66 and therefore, the first link 22 cannot pivot about the first link pivot point 50. Because the first link 22 is stationary, the second plier member assembly jaw portion second pivot point 84, which is located at the distal end of the first link 22, is also stationary. As the user continues to apply force in the direction "B," the second plier member assembly handle member 34 and the second plier member assembly second link member 36 now pivot about the toggle pivot point 110 causing the toggle angle to become more obtuse as the axis of the second plier member assembly handle member 34 and the axis of the second plier member assembly second link member 36 move into a parallel relationship. As the toggle angle becomes more obtuse, the total distance between the jaw portion first pivot point 52 and the handle member pivot point 92 is increased. To compensate for increased distance between the jaw portion first pivot 52 point and the handle member pivot point 92, the second plier member assembly movable member 28, and therefore the second plier member assembly jaw portion 30, pivots about the second plier member assembly jaw portion second pivot point 84.

As shown in FIGS. 7-10, the second embodiment of the pliers 10 operates in a similar manner as the embodiment shown in FIGS. 2-5. The difference between the first embodiment of the pliers 10 and the second embodiment of the pliers 10A is in the cam release device. In the second embodiment of the pliers 10A, the first phase of operation is similar to the first phase described above, except that the cam member 132 is held in the first position by the tension link 162. That is, while the second plier member assembly handle 34 and second plier member assembly second link 36 are maintained at the initial toggle angle, the second link release extension 164 is spaced an initial distance from the cam pivot point opening 134. While at the initial distance, the tension link pin 168 engages the tension link 162 by acting against the end of the tension link slot 166. The tension link 162 further acts upon the cam member release pin counteracting the force applied by the cam spring 136 and holding the cam member 132 in a spaced relation from the tension member 66.

During the transition phase, the cam release device operates as follows. After the first plier member assembly jaw portion 16 and the second plier member assembly jaw portion 30 contact the workpiece A, the force applied to the second plier member assembly 14 overcomes the biasing force of the toggle spring 150 causing the second plier member assembly handle member 34 to move relative to the second link member 36. That is, as before, the toggle angle becomes more obtuse. As the toggle angle becomes more obtuse, the second link release extension 164 located at the second link member first end 121 moves toward the cam pivot point opening 134. As the second link release extension 164 moves toward the cam pivot point opening 134, the tension link pin 168 slides in the tension link slot 166. Because the tension link pin 168 moves into the tension link slot 166, the tension link pin 168 no longer acts upon the end of the tension link slot 166 and the tension link 162 no longer counteracts the cam member spring 136. Thus, the cam member spring 136 acts to move the cam member 132 into contact with the tension member 66. Once the cam member 132 fully engages the tension member 66, the second embodiment of the pliers 10A moves into the second phase. The second phase of operation for the second embodiment of the pliers 10A is essentially identical to the second phase of operation for the first embodiment of the pliers 10.

As shown in FIGS. 7-10, in operation, the locking assembly 190 is used as follows. Preferably, during the first phase, the lug assembly 206 is in the first position, therefore the pawl 196 is in the rack engaging position. However, at this point, the pawl tooth 197 is only contacting the first rack tooth angled side 193 and, as such, the pawl 196 is not latched against the rack. During the closing portion of the first pivot phase, the toggle angle remains constant and the pawl tooth 197 does not move relative to the rack 192. During the transition phase and the second phase, the second plier member assembly handle member 34 moves relative to the second link member 36 drawing the pawl 196 across the rack 192. The pawl tooth 197 slides over the rack teeth angled sides 193. When the second phase is complete, the pawl tooth 197 moves into engagement with the adjacent rack tooth latching surface 195. At this point the pliers 10 are locked and the first plier member assembly 12 cannot move away from the second plier member assembly 14. That is, the jaw portions 16, 30 cannot rotate about the jaw portion first pivot point 52 because the cam assembly 130 has engaged the tension member 66, and the jaw portions 16, 30 cannot rotate about the jaw portion second pivot point 84 because the locking assembly 190 has fixed the toggle angle.

To disengage the lock assembly 190, the user slides the lug assembly 206 to the second position. As the engagement extension 208 moves from contacting the pawl engagement tab arced surface 201 and into the engagement extension cavity 209, the disengagement extension 210 moves form the disengagement extension cavity 211 into contact with the pawl disengagement tab arced surface 205, thereby causing the pawl to move from the rack engaging position to the disengaged position. At this point the pliers 10 are unlocked and the first plier member assembly 12 can move away from the second plier member assembly 14. After the opening spring 152 has separated the first and second plier member assemblies 12, 14, the lug assembly 206 is moved back to the first position.

Figure 13:
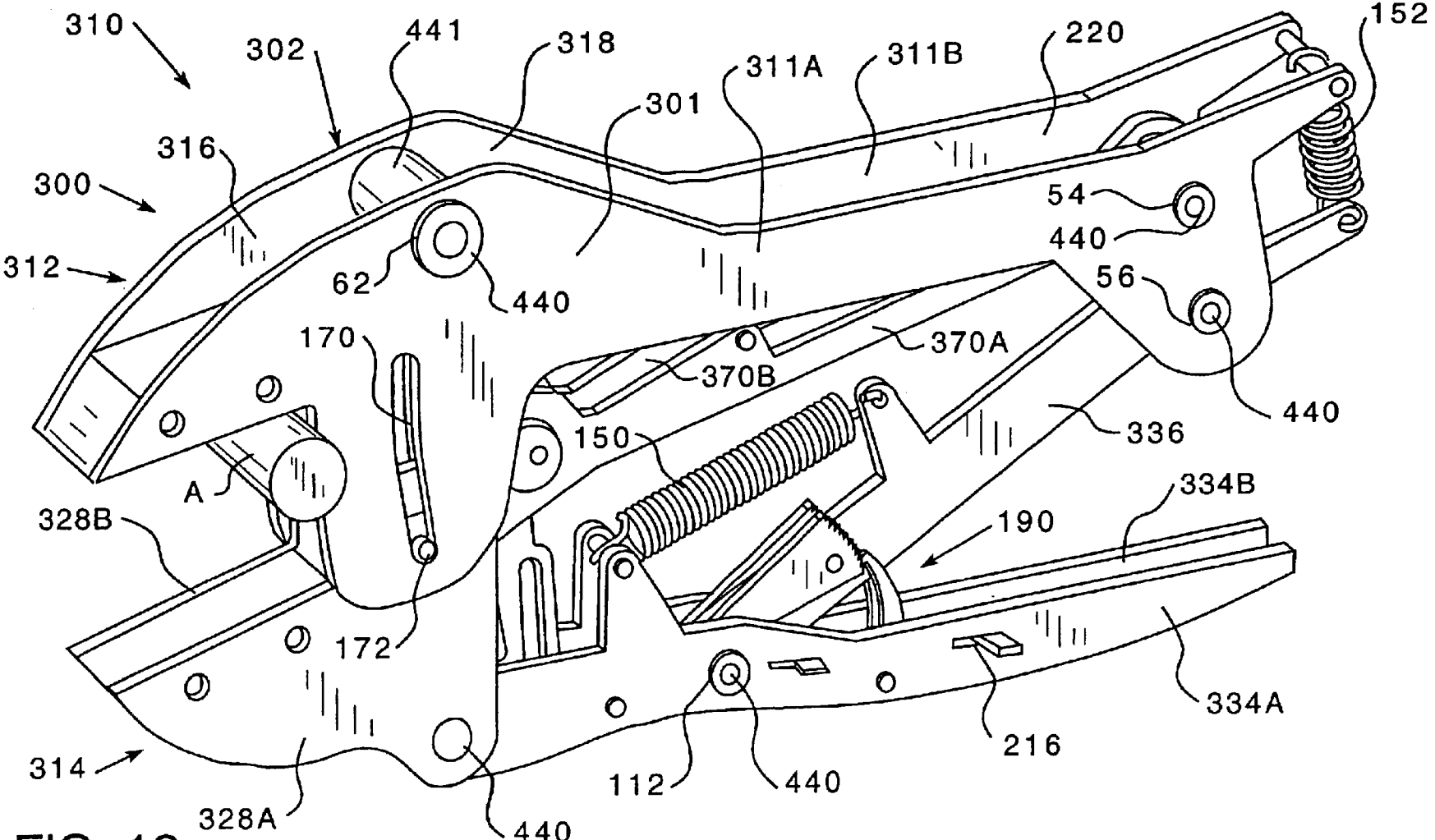
FIG. 13 is an isometric view of the second embodiment of the pliers.
Figure 14:
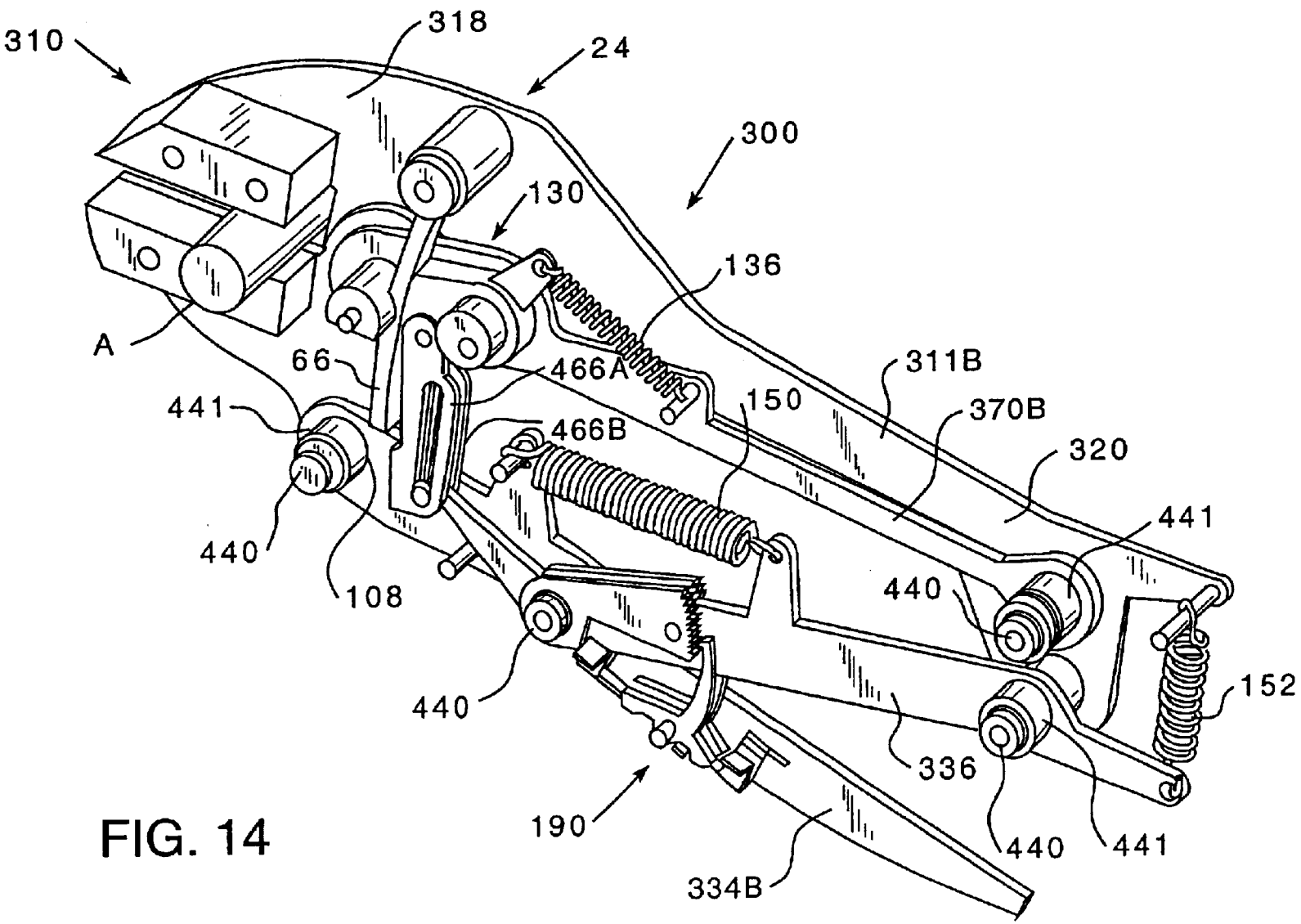
FIG. 14 is an isometric cross-sectional view of the second embodiment of the pliers.

As shown in FIGS. 13 and 14, the pliers 10A (second embodiment shown) are preferably constructed from a plurality of laminations 300, hereinafter, the laminate pliers 310. The laminations 300 are preferably cut or stamped from a sheet of metal. The laminations 300 form the various plier components, e.g., first plier member assembly 12 and second plier member assembly 14. The laminations 300 are erected in multiple layers. Preferably, the outer layers are mirror images of each other about a single center layer. That is, as shown in FIG. 13, the laminate pliers 310 have a first side 301 and a second side 302 and the components 12, 14 are made from mirror image laminations 300 on both the first and second sides 301, 302. For example, a laminate pliers 310 first plier member assembly 312 includes two generally flat members 311A, 311B forming a jaw portion 316, an intermediate portion 318 and a handle portion 320. The two first plier member assembly members 311A, 311B are the outermost layer on the first and second sides 301, 302. The laminate pliers 310 second plier member assembly 314 includes two generally flat moving members 328A, 328B which are each disposed in the second layer on both the first and second sides 301, 302. The laminate pliers 310 second plier member assembly 314 also includes two generally flat two handle members 334A, 334B which are each the third layer on both the first and second sides 301, 302. Additionally, the laminate pliers 310 first plier member assembly 312 also includes two generally flat first link bodies 370A, 370B which are also disposed in the third layer on both the first and second sides 301, 302. The tension links 466A and 466B are disposed in the third layer in from both the first and second sides 301, 302. As shown best in FIG. 14, the laminate pliers 310, tension assembly 324 and cam assembly 430 are thicker components, i.e. thicker than the other laminations or layers, and are disposed centrally between the first and second sides 301, 302. Unlike the outer layers, the central layer does not have mirror image components. The laminate pliers 310 second link member 336 is also disposed in the central layer. The components of the laminate pliers 310 are coupled together by pivot rods 440 disposed at the locations identified above. The pivot rods 440 extend generally perpendicular to the planes of the flat components of the laminate pliers 310. The pivot rods 440 may further include spacers 441 structured to maintain the components of the laminate pliers 310 in the proper layer.

Figure 15:
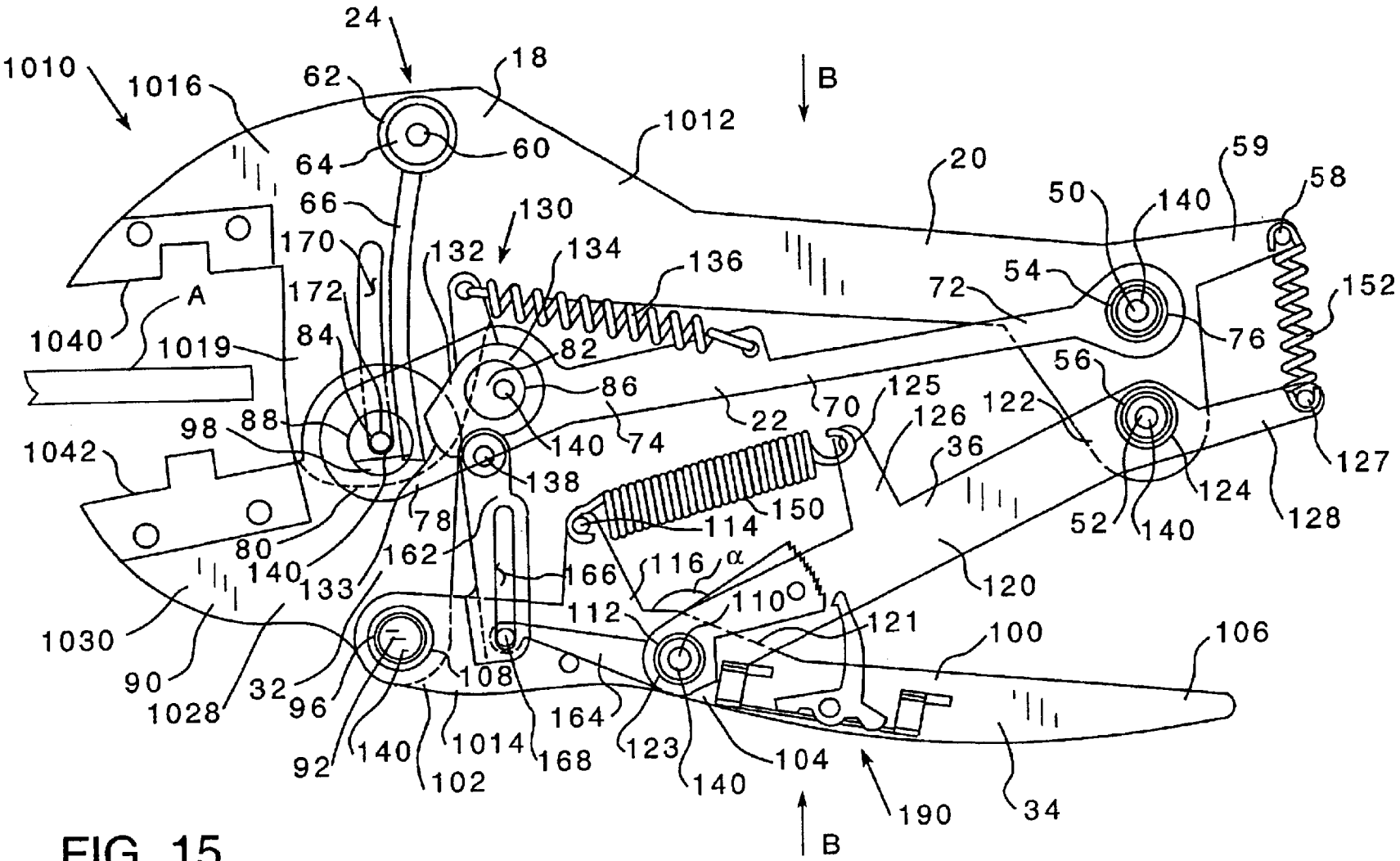
FIG. 15 shows a hand tool having crimping jaw portions at the beginning of the first phase of operation.
Figure 26:
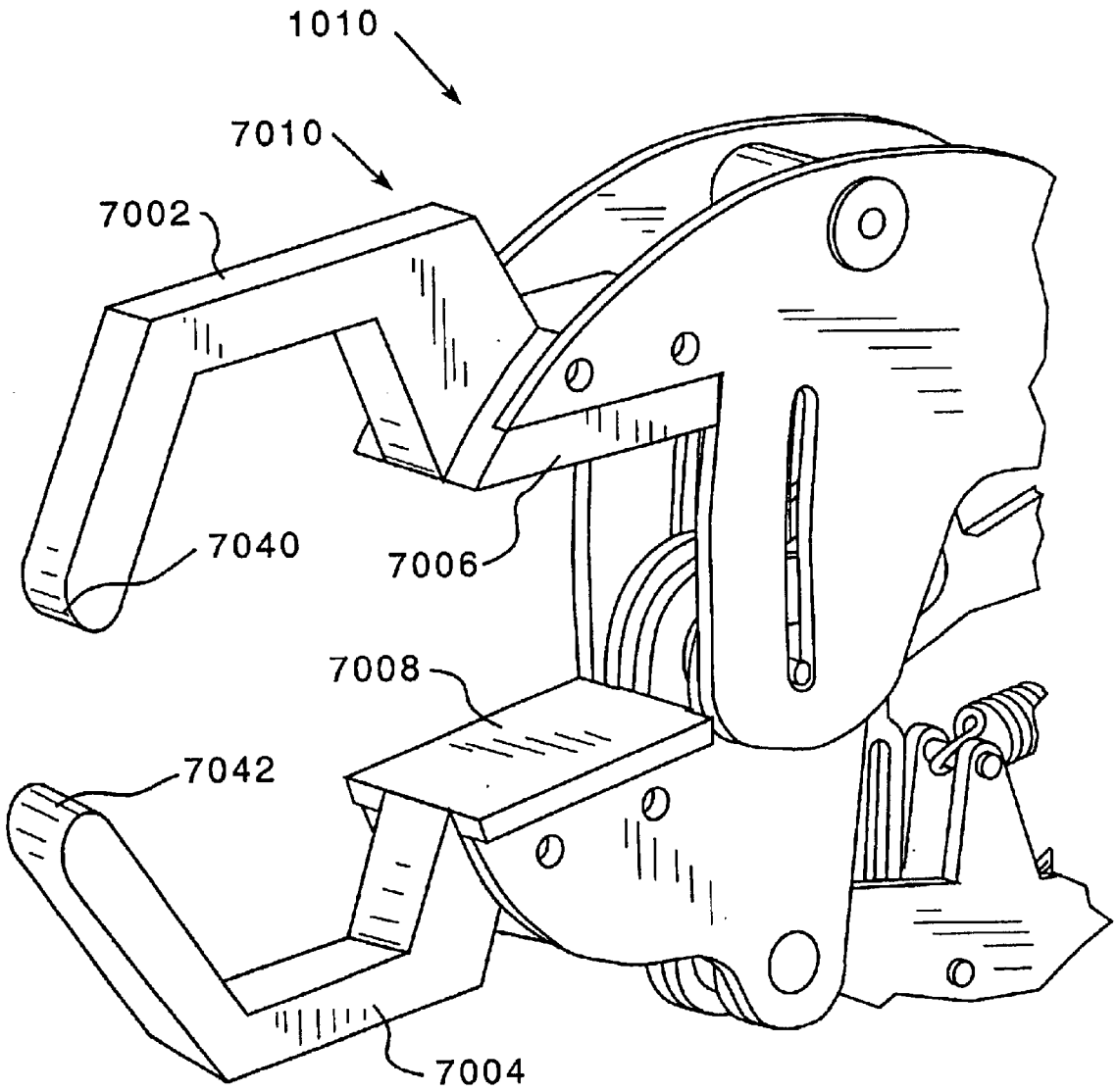
FIG. 26 is an isometric view of the hand tool as a welding clamp.
Figure 27:
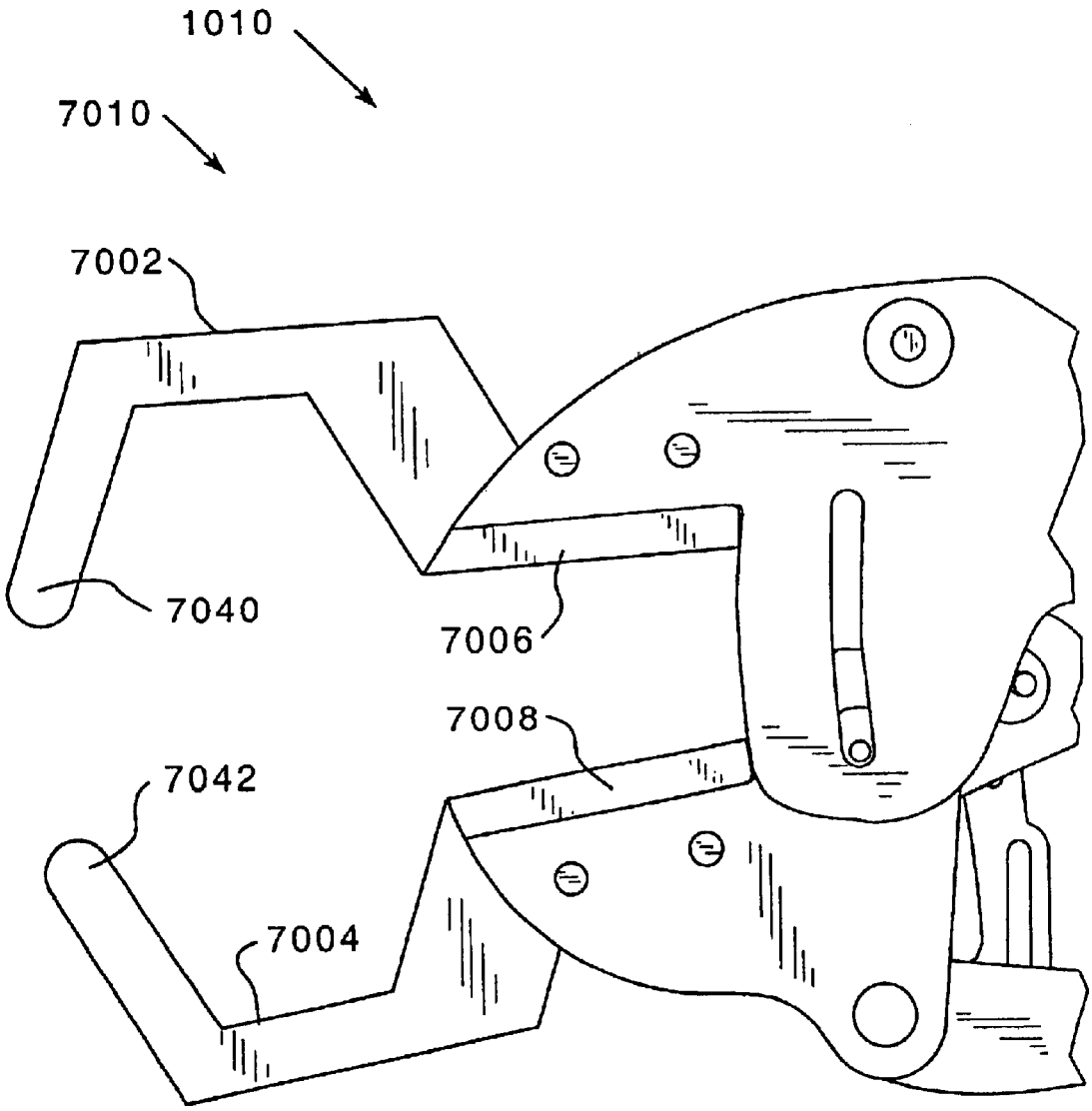
FIG. 27 is a side view of the hand tool as a welding clamp.

In addition to a pair of pliers 10, the closing arrangement described above, i.e. the cam assembly 130 cooperating with the first link pivot point 50, first and second jaw portion pivot points 52, 84, the handle member pivot point 92, and the toggle pivot point 110, is also adapted for use on a hand tool 1010, as shown in FIG. 15. The hand tool may be, but is not limited to, a shearing tool 2010 (FIGS. 16, 17), a cutting tool 3010 (FIGS. 18, 19), a crimping tool 4010 (FIGS. 20, 21), a punch 5010 (FIGS. 22, 23), an adjustable wrench 6010 (FIGS. 24, 25), or a welding clamp 7010 (FIGS. 26, 27). Features of the hand tool 1010 that differ from the pliers 10 described above are identified with new reference numbers. Features of the hand tool 1010 that are substantially similar to the pliers 10, however, are identified with the same reference numbers used above in conjunction with the pliers 10.

As shown in FIGS. 15-27, a hand tool 1010 has several embodiments including, but not limited to, a shearing tool 2010, a cutting tool 3010, a crimping tool 4010, a punch 5010, an adjustable wrench 6010, or a welding clamp 7010. The hand tool includes first hand tool member assembly 1012 and second hand tool member assembly 1014. The first hand tool member assembly 1012 is rigid and has a jaw portion 1016, an intermediate portion 1018, an elongated handle portion 1020, a first link 22, a tension assembly 24, and a cam assembly 130. The second hand tool member assembly 1014 is non-rigid having a movable member 1028, which includes a jaw portion 1030, an intermediate portion 1032, and an elongated handle member 34, and a second link 36. The first and second member assemblies 1012, 1014 do not intersect each other. That is, the first hand tool member assembly jaw portion 1016 and the first hand tool member assembly handle portion 1020 are disposed on the same side of the first and second jaw portion pivot points 52, 84 (described below).

As shown in FIG. 15, the first hand tool member assembly jaw portion 1016 includes a first closing surface 1040 that is structured to engage a workpiece "A." The shape of the first closing surface 1040 and the second closing surface 1042 (described below) vary with each embodiment of the hand tool 1010. The closing surfaces 1040, 1042 face each other and are generally parallel to each other. However, it is noted that, when the hand tool 1010 is fully open, that is at the beginning of the first pivot phase described below, the closing surfaces 1040, 1042 may be at a slight angle relative to each other.

Figure 16:
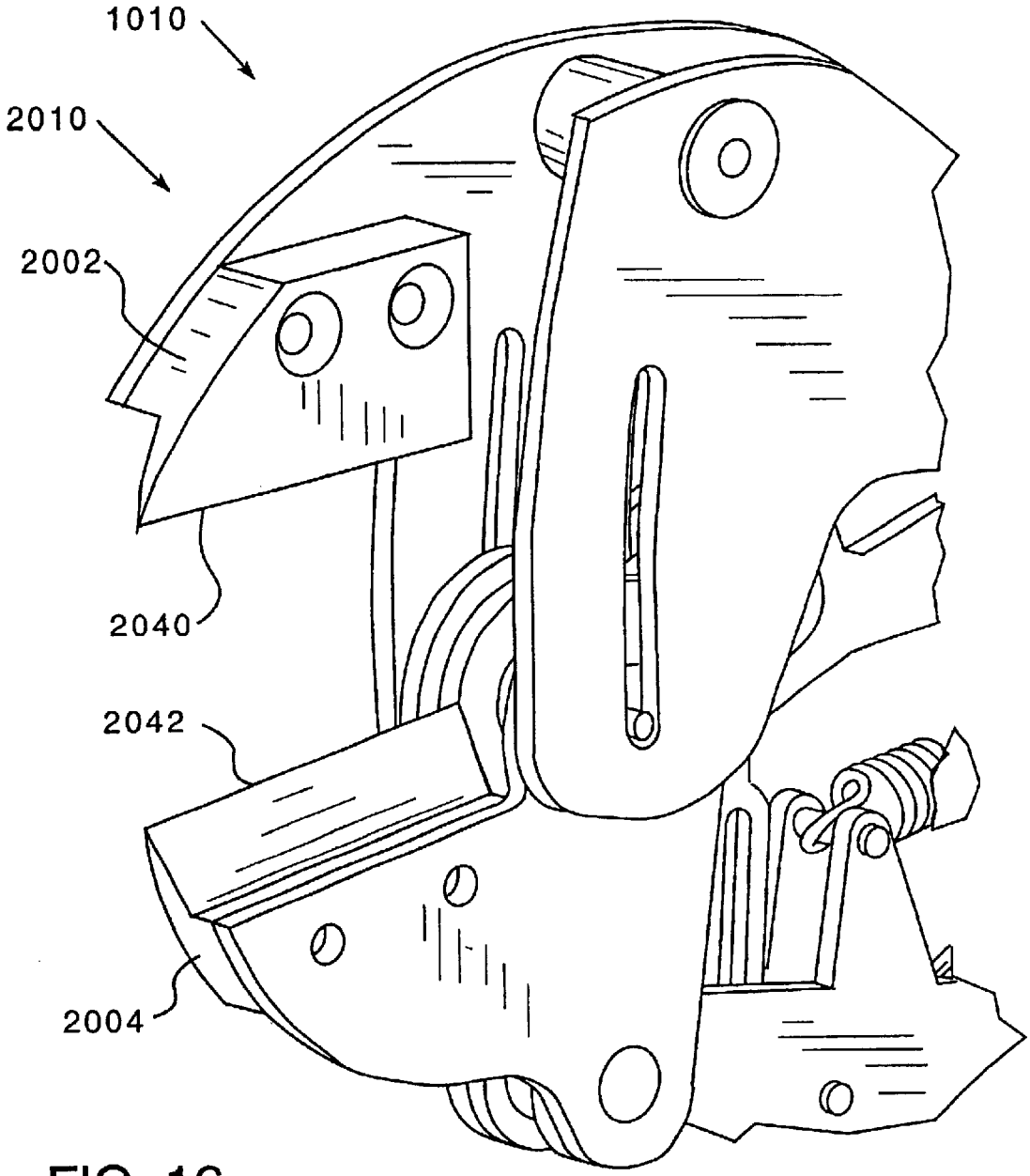
FIG. 16 is an isometric view of the hand tool as a shearing tool.
Figure 17:
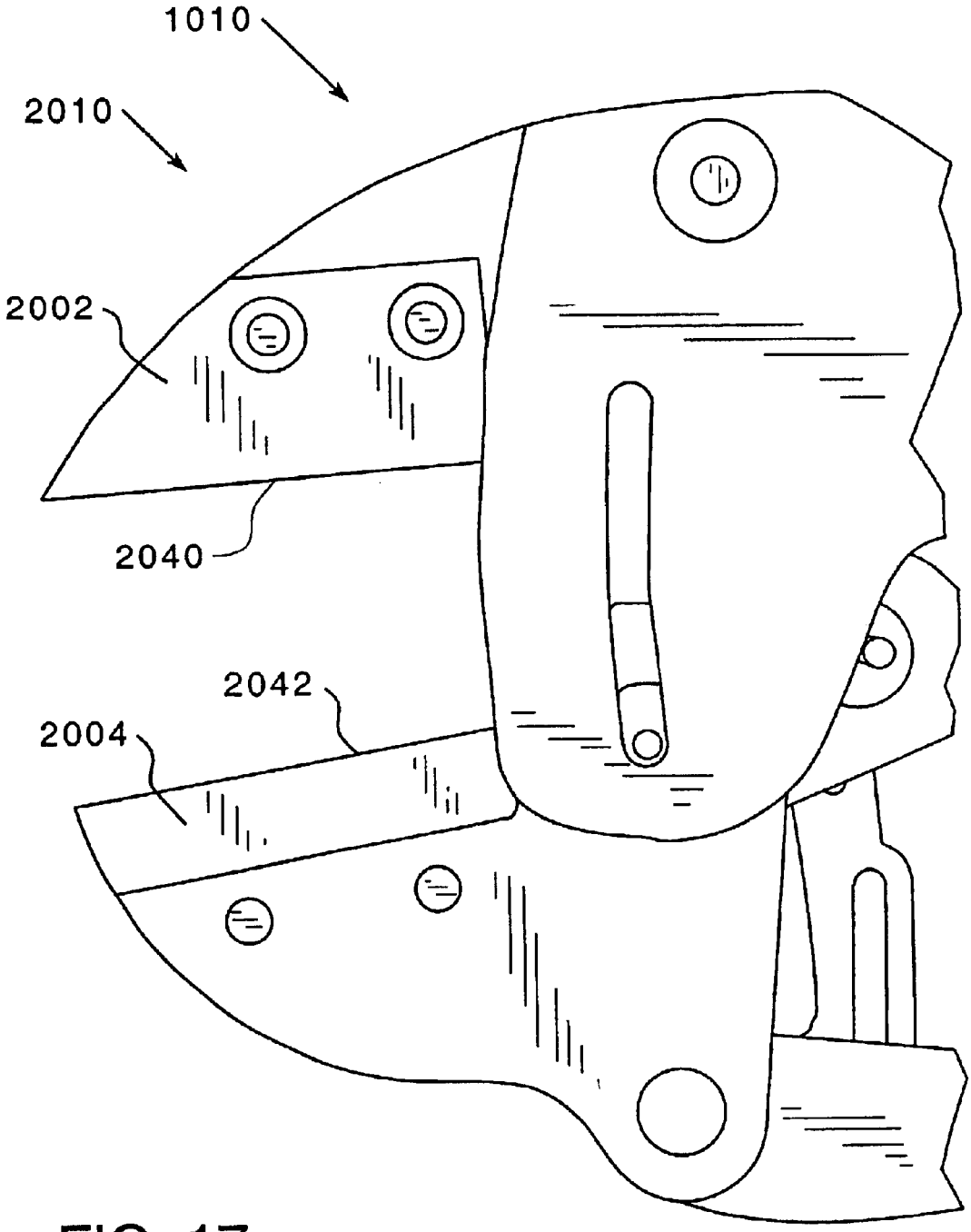
FIG. 17 is a side view of the hand tool as a shearing tool.

As shown in FIGS. 16 and 17, when the hand tool 1010 is a shearing tool 2010, the closing surfaces 1040, 1042 are a first shearing surface 2040, and a second shearing surface 2042. The shearing surfaces 2040, 2042 are disposed on a first blade 2002 and a second blade 2004. The first and second blades 2002, 2004 are sized with a thickness such that, as the hand tool jaw portions 1016, 1030 close, the shearing surfaces 2040, 2042 are disposed immediately adjacent to each other, but do not contact each other. The body of the first and second blade 2002, 2004 may contact each other.

Figure 18:
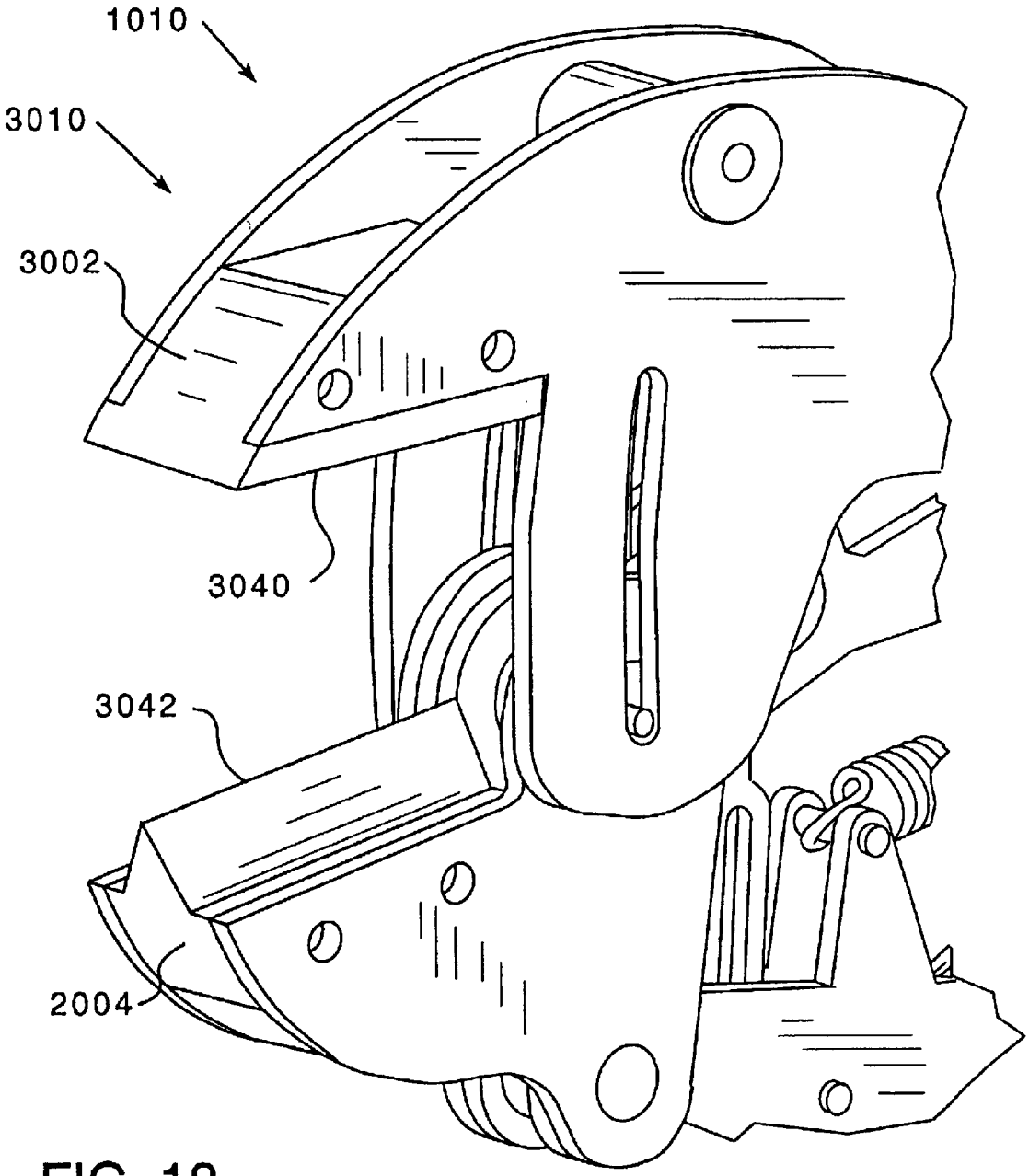
FIG. 18 is an isometric view of the hand tool as a cutting tool.
Figure 19:
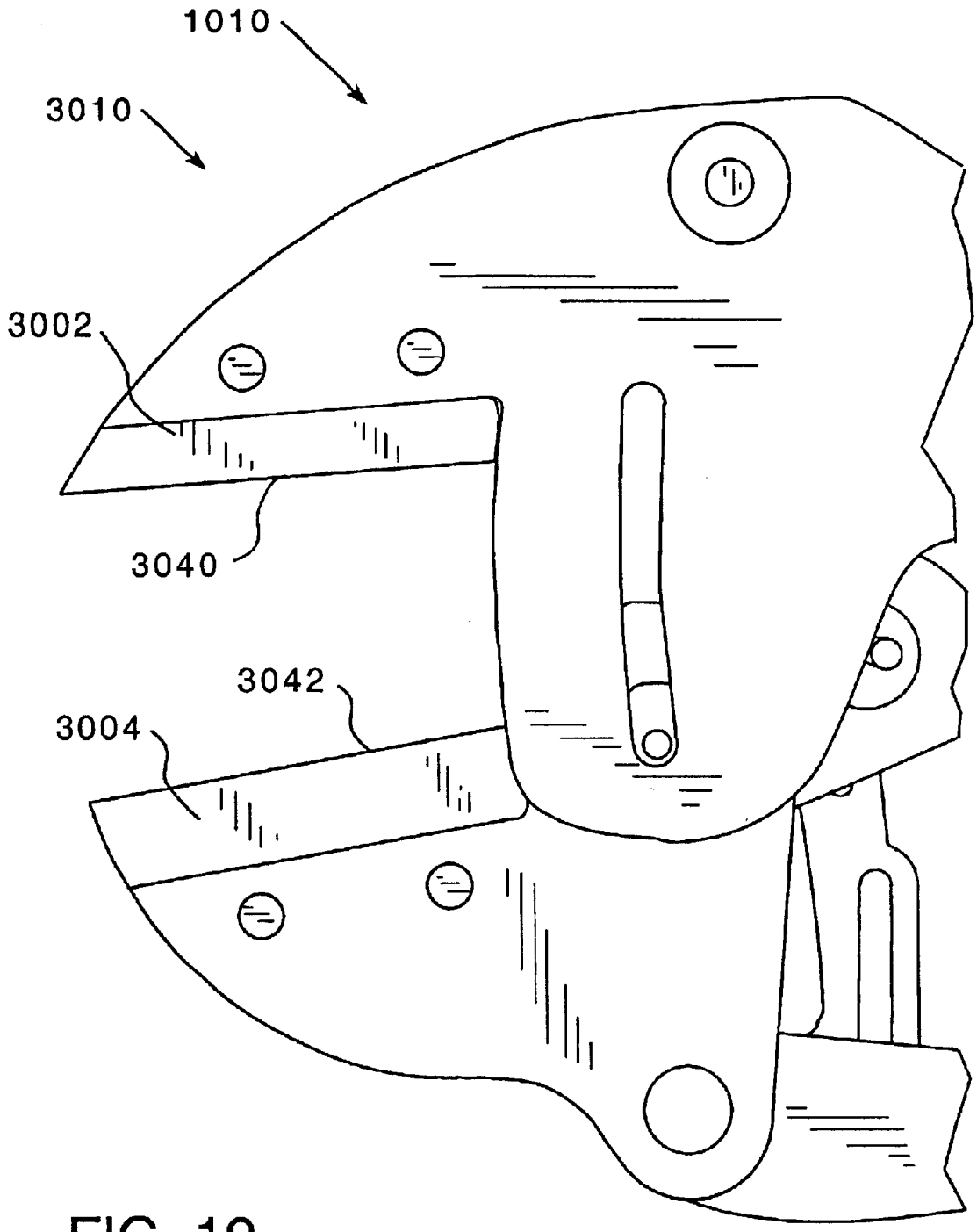
FIG. 19 is a side view of the hand tool as a cutting tool.

As shown in FIGS. 18 and 19, when the hand tool 1010 is a cutting tool 3010, the closing surfaces 1040, 1042 are an anvil surface 3040, and a cutting surface 3042. The anvil surface 3040 is a generally flat surface disposed on a plug 3002. The cutting surface 3042 is disposed on a wedge shaped blade 3004. As shown in the figures the anvil surface 3040 is coupled to the first hand tool member assembly 1012 and the cutting surface 3042 is coupled to the second hand tool member assembly 1014. However, the anvil surface 3040 may be coupled to the second hand tool member assembly 1014 and the cutting surface 3042 may be coupled to the first hand tool member assembly 1012.

Figure 20:
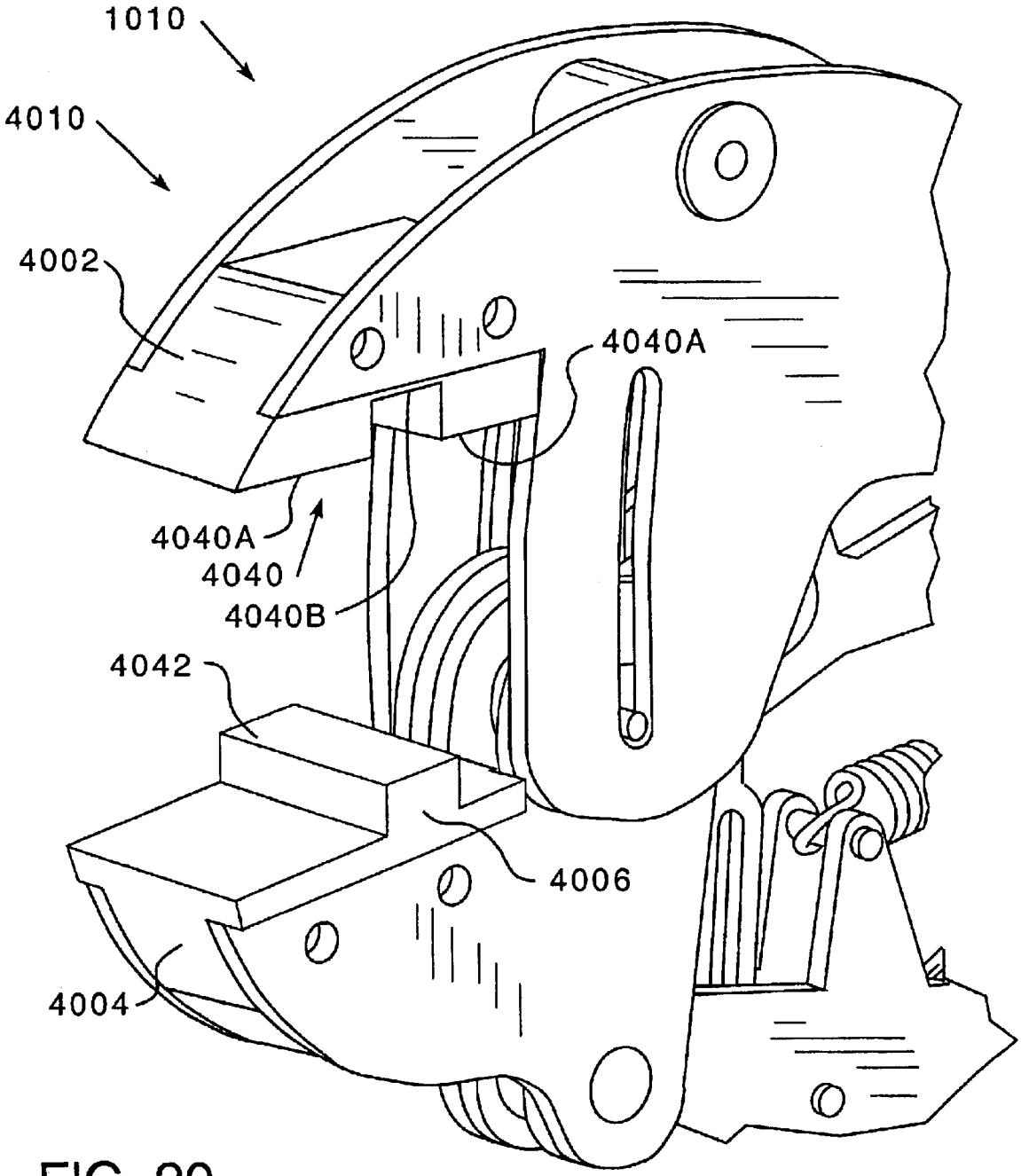
FIG. 20 is an isometric view of the hand tool as a crimping tool.
Figure 21:
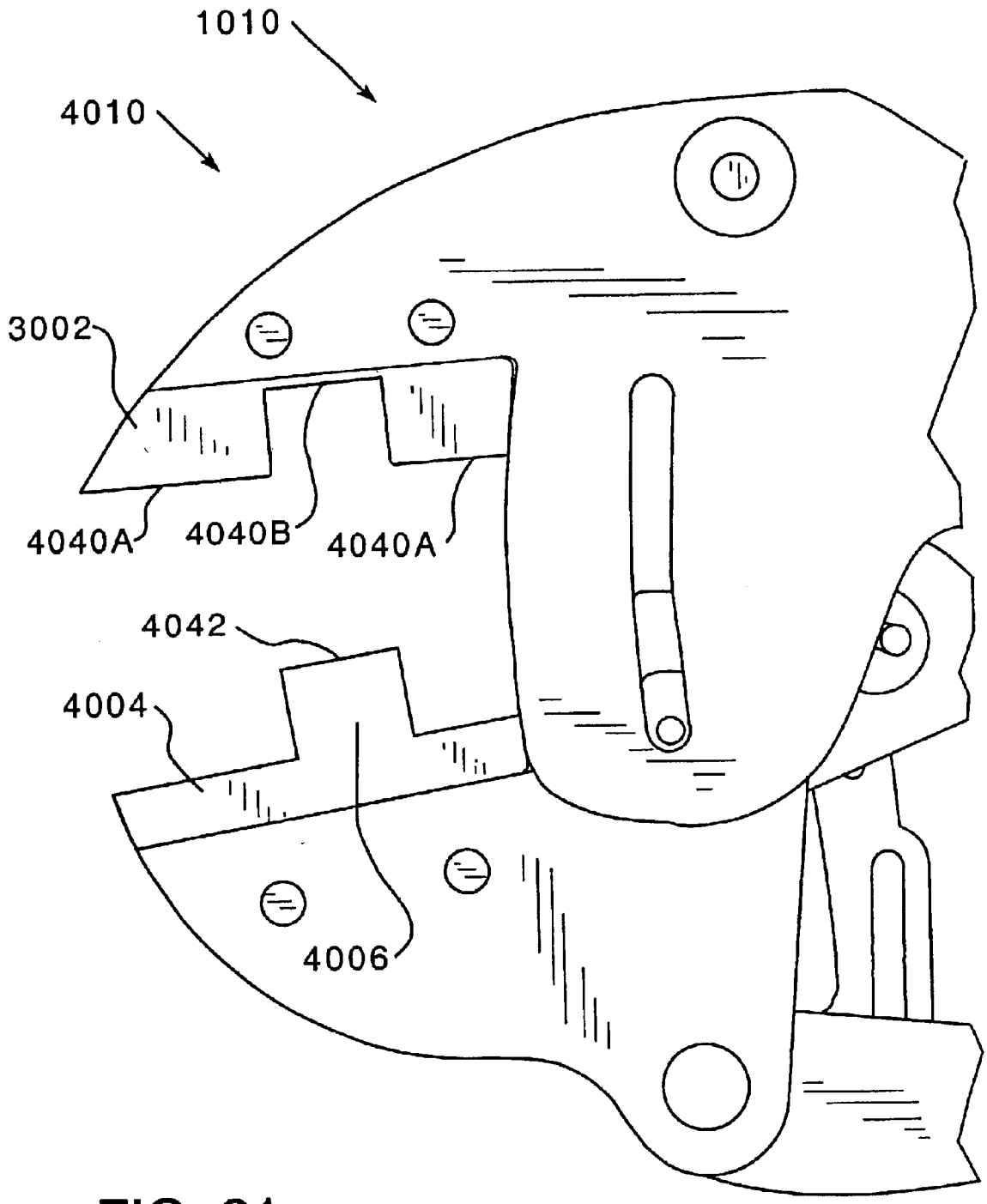
FIG. 21 is a side view of the hand tool as a crimping tool.

As shown in FIGS. 20 and 21, when the hand tool 1010 is a crimping tool 4010, the closing surfaces 1040, 1042 are a recess surface 4040, and a projection surface 4042. The recess surface 4040 is a surface having two generally flat, parallel surfaces 4040A disposed on either side lower-level flat surface 4040B. The recess surface 4040 is disposed on a recess plug 4002. The projection surface 4042 is disposed on a plug 4004 having a projection 4006. The projection 4006 has the same general cross-sectional area as the lower level flat surface 4040B. Thus, the projection surface 4042 corresponds to the recess surface 4040. As shown in the figures the recess surface 4040 is coupled to the first hand tool member assembly 1012 and the projection surface 4042 is coupled to the second hand tool member assembly 1014. However, the recess surface 4040 may be coupled to the second hand tool member assembly 1014 and the projection surface 4042 may be coupled to the first hand tool member assembly 1012.

Figure 22:
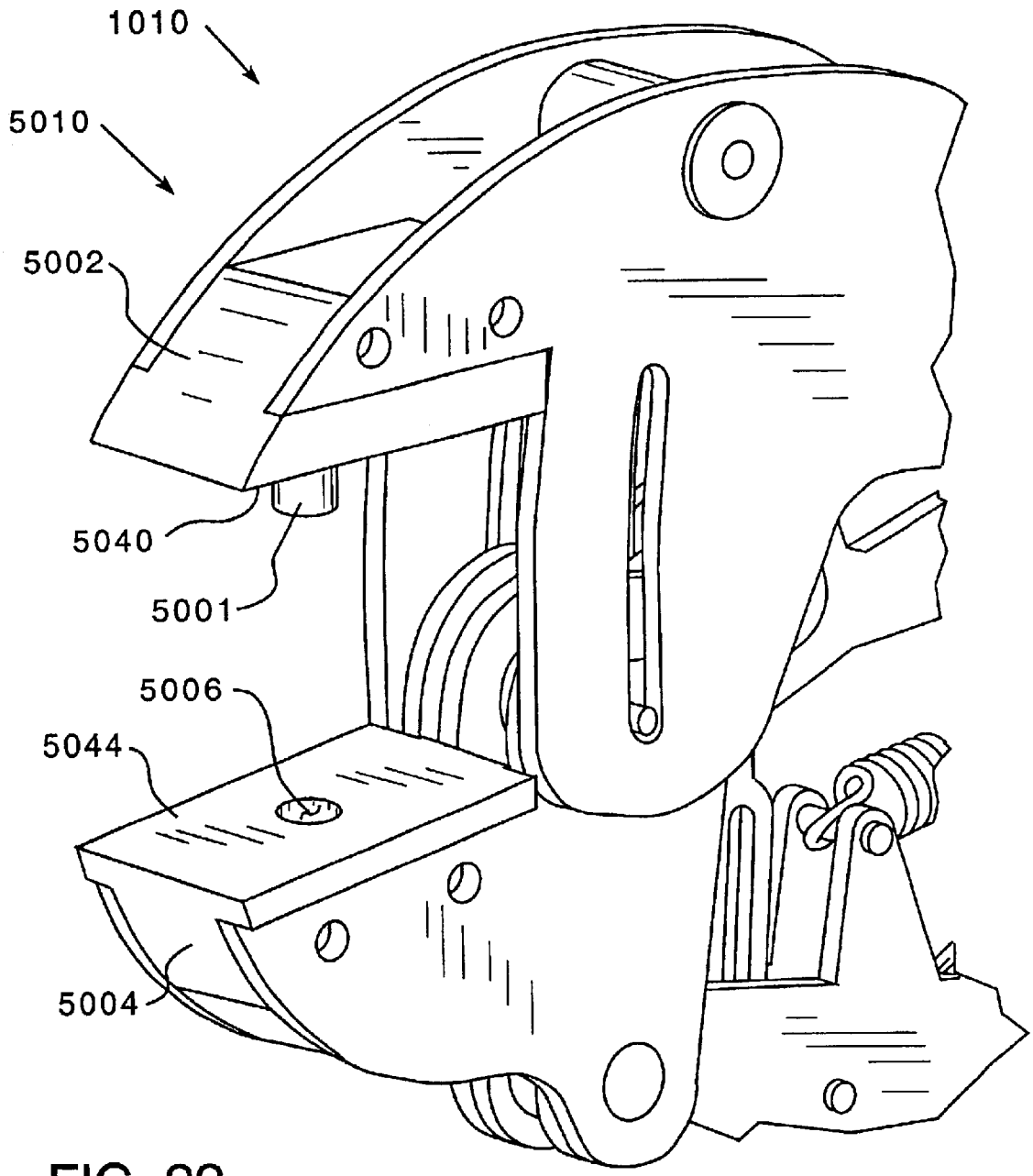
FIG. 22 is an isometric view of the hand tool as a punch.
Figure 23:
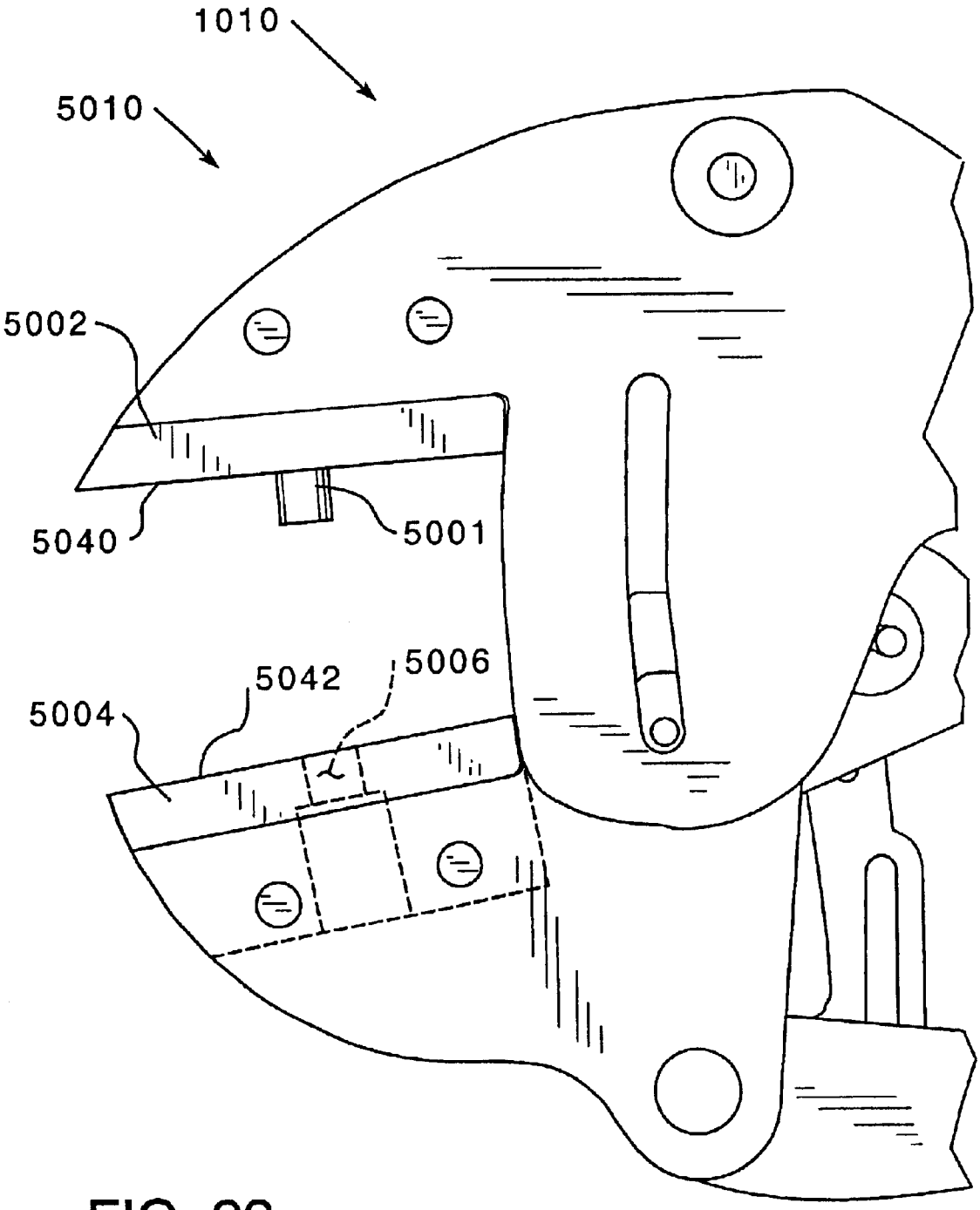
FIG. 23 is a side view of the hand tool as a punch.

As shown in FIGS. 22 and 23, when the hand tool 1010 is a punch 5010, the closing surfaces 1040, 1042 are a punching surface 5040, and a die surface 5042. The punching surface 5040 is a generally flat surface having a localized protrusion 5001. The punching surface 5040 is disposed on a punch plug 5002. The localized protrusion 5001 is substantially smaller than the punching surface 5040. The die surface 5042 is disposed on a die plug 5004 having an opening 5006. The opening 5006 has the same general cross-sectional area as the protrusion 5001. Thus, the protrusion 5001 is sized to correspond to the size of the opening 5006. As shown in the figures the punching surface 5040 is coupled to the first hand tool member assembly 1012 and the die surface 5042 is coupled to the second hand tool member assembly 1014. However, the punching surface 5040 may be coupled to the second hand tool member assembly 1014 and the die surface 5042 may be coupled to the first hand tool member assembly 1012.

Figure 24:
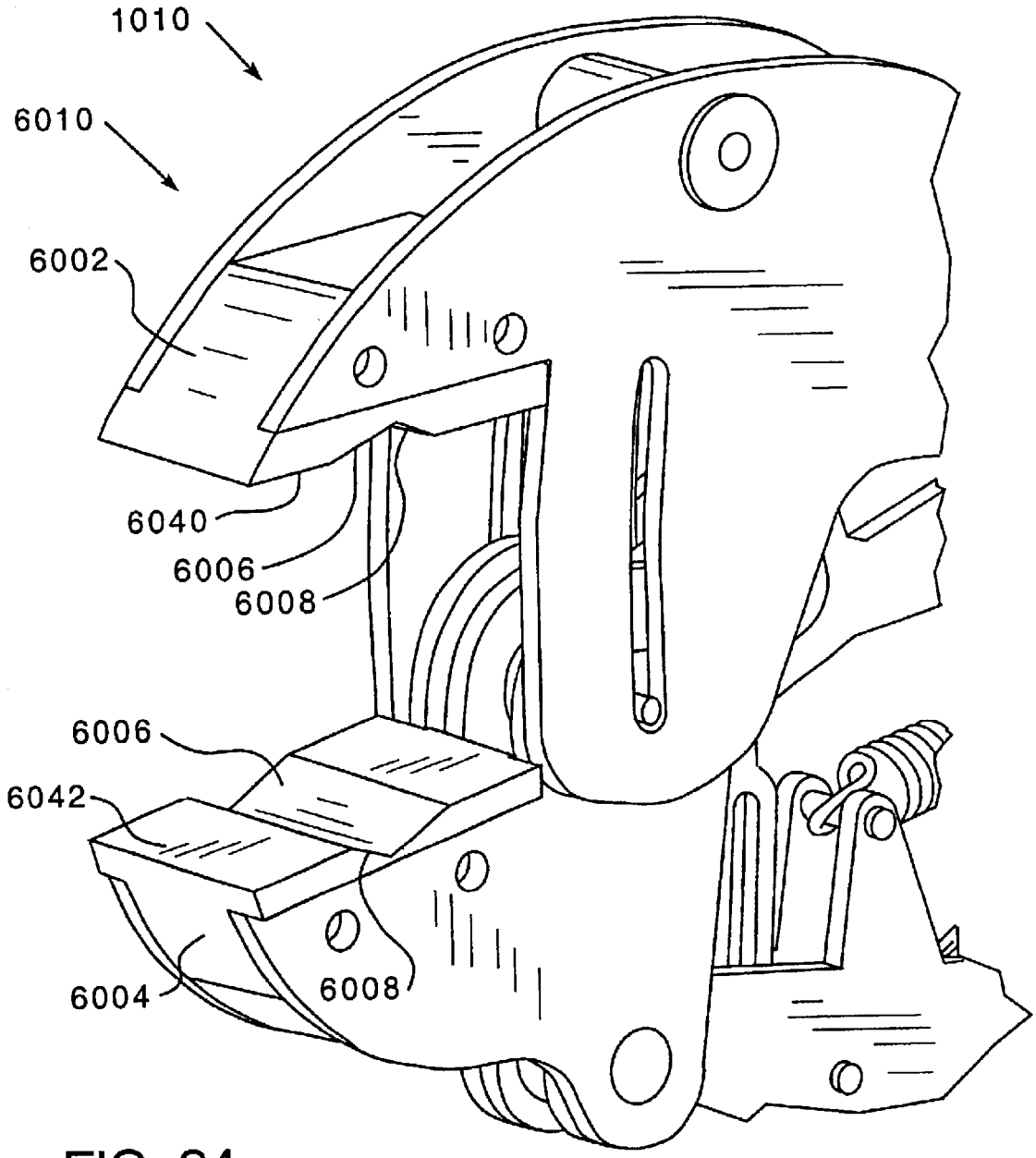
FIG. 24 is an isometric view of the hand tool as an adjustable wrench.
Figure 25:
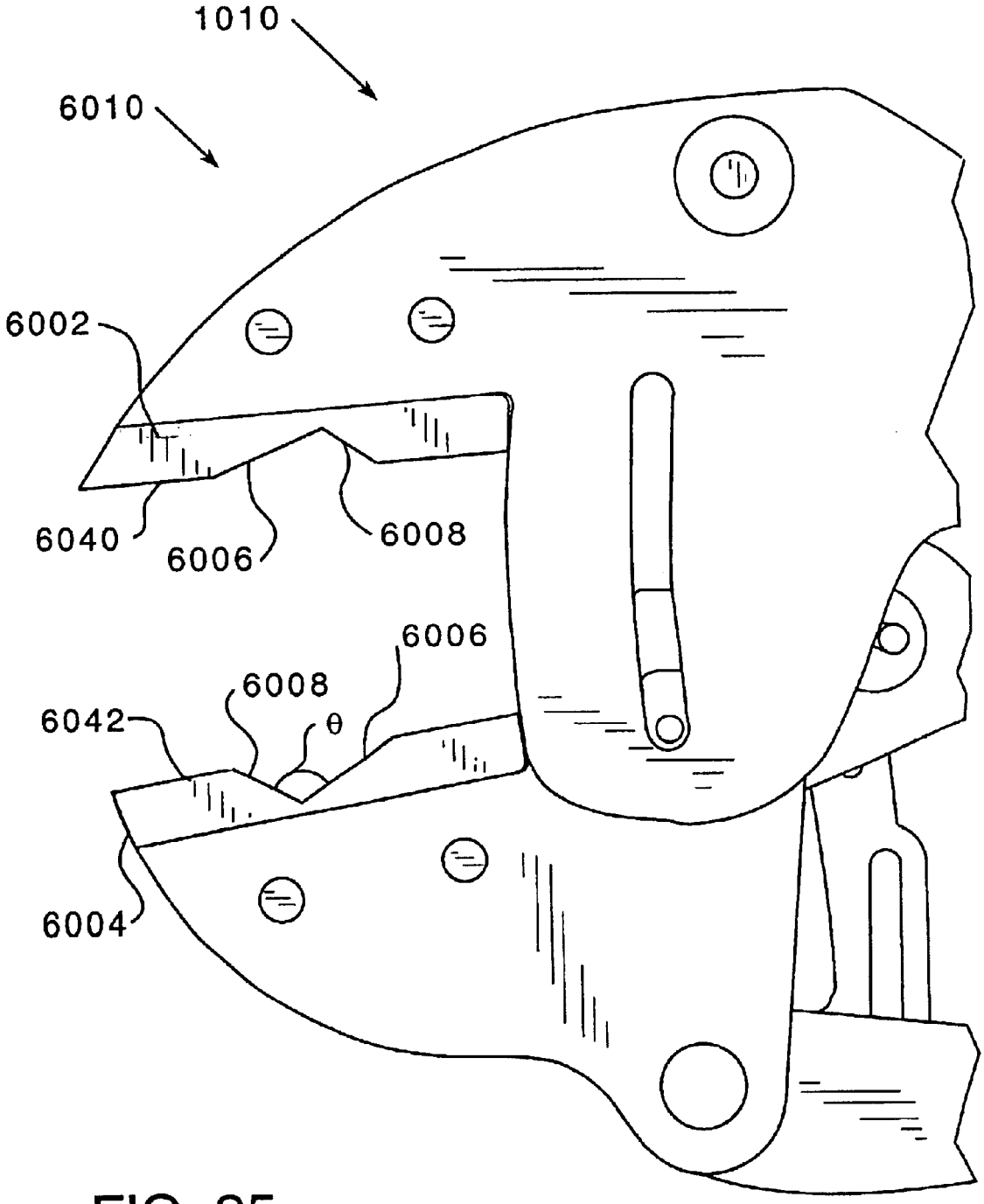
FIG. 25 is a side view of the hand tool as an adjustable wrench.

As shown in FIGS. 24 and 25, when the hand tool 1010 is an adjustable wrench 6010, the closing surfaces 1040, 1042 are a first notched surface 6040, and a second notched surface 6042. The notched surfaces 6040, 6042 are disposed on a first notched plug 6002 and a second notched plug 6004. Preferably, each notch is formed with a long side 6006 and a short side 6008. The notch long side 6006 and notch short side 6008 preferably form an obtuse angle $h$.

As shown in FIGS. 26 and 27, when the hand tool 1010 is welding clamp 7010, the closing surfaces 1040, 1042 are a first clamp surface 7040 and a second clamp surface 7042. The clamp surfaces 7040, 7042 are disposed at the distal ends of a first and second C-shaped member 7002, 7004, respectively. Each C-shaped member 7002, 7004 includes a mounting plug 7006, 7008 that can be coupled to either the first hand tool member assembly jaw portion 1016 or the second hand tool member assembly jaw portion 1030.

As shown in FIG. 15, adjacent to, and integral with, the first hand tool member assembly jaw portion 1016 is the first hand tool member assembly intermediate portion 1018. The first hand tool member assembly intermediate portion 1018 includes a side plate 1019 that extends toward the second hand tool member assembly 1014 in a direction generally perpendicular to the first closing surface 1040. Adjacent to, and integral with, the first hand tool member assembly intermediate portion 1018 is the first hand tool member assembly elongated handle portion 1020. At the distal end of the first hand tool member assembly handle portion 1020 are two pivot points, a first link pivot point 50 and jaw portion first pivot point 52. The first link pivot point 50 and the jaw portion first pivot point 52 each include an opening on the first hand tool member assembly handle portion; a first link pivot point opening 54 and a jaw portion first pivot point opening 56. The first hand tool member assembly handle portion 1020 also includes an opening spring attachment point 58. The opening spring attachment point 58 is typically an opening that may be coupled to an opening spring 152 (described below). The first hand tool member assembly handle portion opening spring attachment point 58 may be located on an extension 59 that allows the opening spring attachment point 58 to be spaced from the jaw portion first pivot point opening 56.

The first hand tool member assembly intermediate portion 1018 includes a tension assembly pivot point 60. The tension assembly 24 is substantially similar to the tension assembly 24 described above associated with the pliers 10. The tension assembly pivot point includes a tension assembly pivot point opening 62 in the first hand tool member assembly intermediate portion 1018. The first hand tool member assembly tension assembly 24 includes a pivot rod 64 having an elongated tension member 66 extending radially therefrom. The tension assembly pivot rod 64 is sized to fit within the tension assembly pivot point opening 62. The tension member 66 may be generally straight or arced. If the tension member 66 is arced, preferably the radius is about the distance between the jaw portion first pivot point 52 to the tension assembly pivot rod 64.

The hand tool first link 22 is substantially similar to the first link 22 included in the pliers 10 described above. The first link 22 includes an elongated body 70 having a first end 72 and a second end 74. A first link pivot point opening 76 is disposed at the first link body first end 72. An end plate 78 is disposed at the first link second end 74. The end plate 78 includes a generally flat, elongated member 80 and two pivot points; a cam pivot point 82 and a second hand tool member assembly jaw portion second pivot point 84. As before, the end plate flat member cam pivot point 82 and the second hand tool member assembly jaw portion second pivot point 84 each includes an opening, a cam pivot point opening 86 and a jaw portion second pivot point opening 88. The jaw portion second pivot point opening 88 is disposed adjacent to the distal end of the end plate flat member 80 and the cam pivot point opening 86 is disposed adjacent to the first link body 70. The jaw portion second pivot point opening 88, the cam pivot point opening 86 and the first link pivot point opening 76 are, preferably, but not necessarily, disposed linearly.

The first hand tool member assembly 1012 further includes a cam assembly 130 which is substantially similar to the cam assembly 130 described above. That is, the hand tool cam assembly 130 includes a cam member 132 having a cam surface 133 and a cam pivot point opening 134, a cam spring 136 and a cam release device, such as a cam release pin 138 or a release link 139, structured to release the cam as described above.

The second hand tool member assembly movable member 1028 includes a generally flat body 1090 shaped to form the second hand tool member assembly jaw portion 1030 and the second hand tool member assembly intermediate portion 1032. The second hand tool member assembly jaw portion 1030 includes a second closing surface 1042 that is structured to engage workpiece A. The second hand tool member assembly intermediate portion 1032 includes two pivot points; a handle member pivot point 92 and a second hand tool member jaw portion second pivot point 84. The handle member pivot point 92 includes a handle member pivot point opening 96. The second hand tool member assembly jaw portion second pivot point 84 includes a jaw portion second pivot point opening 98.

The second hand tool member assembly handle member 34 is substantially similar to the second plier member assembly handle member 34 described above in relation to the pliers 10. That is, the second hand tool member assembly handle member 34 includes an elongated body 100 having a first end 102, a medial portion 104, and a second end 106. The second hand tool member assembly handle member medial portion 104 is disposed between the second hand tool member assembly handle member first end 102 and the second hand tool member assembly handle member second end 106. The second hand tool member assembly handle member first end 102 includes a handle member pivot point opening 108. A toggle pivot point 110 is located on the second hand tool member assembly handle member medial portion 104. The toggle pivot point 110 includes a toggle pivot point opening 112. Between the second hand tool member assembly handle member first end handle pivot point opening 108 and the second hand tool member assembly handle member toggle pivot point opening 112 is a toggle spring attachment point 114. The handle member toggle spring attachment point 114 is typically an opening that may be coupled to a toggle spring 150. The handle member toggle spring attachment point 114 may be disposed on an extension 116 that allows the handle member toggle spring attachment point 114 to be spaced from the toggle pivot point 110.

The second hand tool member assembly second link member 36 is substantially similar to the second plier member assembly second link member 36 described above in relation to the pliers 10. The second hand tool member assembly second link member 36 includes a generally flat, elongated body 120 having a first end 121 and a second end 122. The second link first end 121 includes a toggle pivot point opening 123. The second link second end 122 includes a jaw portion first pivot point opening 124. Adjacent to the second link first end 121 is a toggle spring attachment point 125. The second link member toggle spring attachment point 125 is typically an opening that may be coupled to a toggle spring 150. The second link toggle spring attachment point 125 may be disposed on an extension 126 that allows the second link toggle spring attachment point 125 to be spaced from the toggle pivot point 110. Adjacent to the second link second end 122 is an opening spring attachment point 127. The second link member opening spring attachment point 127 is typically an opening that may be coupled to an opening spring 152. The second link member opening spring attachment point 127 may be disposed on an extension 128 that allows the second link member opening spring attachment point 127 to be spaced from the jaw portion first pivot point 52.

Using a plurality of pivot rods 140 that extend generally perpendicular to the plane of the tool, the hand tool 10 is assembled as follows. The tension assembly pivot rod 64 is pivotally disposed in the first hand tool member assembly intermediate portion tension assembly pivot point opening 62. The elongated tension member 66 extends toward the distal end of the first hand tool member assembly intermediate portion side plate 1019. The first link first end 72 is pivotally coupled to the first hand tool member assembly handle portion 1020 at the first link pivot point 50 by a pivot rod 140 passing through the first hand tool member assembly handle portion first link pivot point opening 54 and through the first link pivot point opening 76. The second link member 36 is pivotally coupled to the first hand tool member assembly handle portion 20 by a pivot rod 140 passing through the first hand tool member assembly handle portion jaw portion first pivot point opening 56 and through the second link jaw portion first pivot point opening 124. The second hand tool member assembly second link member 36 is further coupled to the second hand tool member assembly handle member 34 at the toggle pivot point 110 by a pivot rod 140 passing through the second link toggle pivot point opening 123 and through the second hand tool member assembly handle member toggle pivot point opening 112.

The second hand tool member assembly handle member 34 is pivotally coupled to the second hand tool member assembly movable member 1028 at the second hand tool member assembly handle member pivot point 92 by a pivot rod 140 passing through the second hand tool member assembly handle member first end handle pivot point opening 108 and the second hand tool member assembly moving member handle member pivot point opening 96. The second hand tool member assembly movable member 1028 is further coupled to the first link 22 at the second hand tool member assembly jaw portion second pivot point 84 by a pivot rod 140 passing through the second hand tool member assembly moving member jaw portion second pivot point opening 98 and through the first hand tool member assembly first link jaw portion second pivot point opening 88. Additionally, the cam member 132 is pivotally coupled to the first link end plate flat member 80 at the cam pivot point 82 by passing a rod 140 through the cam member cam pivot point opening 134 and through the first link cam pivot point opening 86.

A toggle spring 150 is coupled to the second hand tool member assembly handle member 34 and to the second link member 36. The toggle spring 150 is, preferably, a tension spring that extends between the second hand tool member assembly handle member toggle spring attachment point 114 and the second link toggle spring attachment point 125. The toggle spring creates a greater biasing force than the cam spring 136. An opening spring 152 extends between the first hand tool member assembly handle portion and the second hand tool member assembly second link member 36. The opening spring 152 extends between the first hand tool member assembly handle portion opening spring attachment point 58 and the second link opening spring attachment point 127. The opening spring 152 is preferably a tension spring. The toggle spring 150 and the opening spring 152 may also be compression springs.

The tension assembly tension member 66 is disposed between the pivot rod 140 located at the second hand tool member assembly jaw portion second pivot point 84 and the cam member 132. The cam member 132 is structured to pivot about the cam pivot point opening 134 between two positions; a first, non-engaging position and a second, tension bar engaging position. The cam member spring 136 is, preferably, a tension spring coupled to the cam member 132 and to the first link body 70. The cam spring 136 is structured to rotate the cam member 132 about the cam pivot point opening 134 until the cam surface 133 of the cam member 132 engages the tension assembly tension member 66. That is, the cam spring 136 is structured to move the cam member 132 into the second position. The cam member 132 is maintained in the first position by the cam release device described below.

The cam assembly release device is structured to counteract the force applied by the cam spring 136 and thereby keep the cam member 132 from engaging tension member. The hand tool 1010 may further incorporate a cam release device, a stop means to prevent the first hand tool member assembly 1012 and the second hand tool member assembly 1014 from opening too widely, a over-toggle stop pin 180, and a locking assembly 190 as described above. Additionally, operation of the hand tool 1010, that is, closing through a first phase, a transition phase and a second phase, is as described above.

While specific embodiments of the invention have been described in detail, it will be appreciated by those skilled in the art that various modifications and alternatives to those details could be developed in light of the overall teachings of the disclosure. For example, the hand tool 1010 may be adapted to incorporate a removable modular jaw portion. Thus, each of the closing surfaces 2040, 2042, 3040, 3042, 4040, 4042, 5040, 5042, 6040, 6042, 7040, and 7042 could be disposed on a modular jaw portion that can be attached and detached to the hand tool 1010. Accordingly, the particular arrangements disclosed are meant to be illustrative only and not limiting as to the scope of invention which is to be given the full breadth of the claims appended and any and all equivalents thereof.

What is claimed is:

1. A hand tool comprising:

a first hand tool member assembly having a jaw portion, a tension assembly, and a cam assembly;

a second hand tool member assembly having a jaw portion;

a jaw portion first pivot point coupling said first hand tool member assembly to said second member assembly;

a jaw portion second pivot point coupling said first hand tool member assembly to said second member assembly, said jaw portion second pivot point located closer to said first member and second member jaw portions than said jaw portion first pivot point;

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first hand tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

2. The hand tool of claim 1, wherein:

said first hand tool member assembly includes an intermediate portion, a handle portion and a first link;

said first link has an elongated body having a first end and a second end;

said first end pivotably coupled to said first member handle portion; and said second pivot point disposed adjacent to said first link second end; and said cam assembly coupled to said first link.

3. The hand tool of claim 2, wherein said first link includes an end generally plate having a flat member at said second end; and said end plate supports said second pivot point and said cam assembly.

4. The hand tool of claim 3, wherein:

said cam assembly includes a cam member and a cam engaging element; and said cam assembly being structured to move between a first position wherein said cam member moves along said tension assembly and a second position wherein said cam member engages said tension assembly.

5. The hand tool of claim 4, wherein:

said tension assembly includes an elongated tension member coupled to a pivot rod;

said jaw portion second pivot point includes a pivot rod coupled to said flat member;

said jaw portion second pivot point rod contacting one side of said tension member; and said cam contacting the other side of said tension member.

6. The hand tool of claim 3, wherein said second hand tool member assembly includes a movable member incorporating said jaw portion and having an intermediate portion, a handle member, and a second link;

said intermediate portion having a jaw portion second pivot point opening therethrough;

said jaw portion second pivot point rod extending through said moveable member intermediate jaw portion second pivot point opening;

said handle member pivotably coupled to said movable member intermediate portion; and said second link having a first end and a second end, said first end pivotably coupled to said handle member, said second end coupled to said first hand tool member assembly handle portion at said jaw portion first pivot point.

7. The hand tool of claim 6, wherein:

said second link is coupled to said handle member at a toggle pivot point;

said handle member and said second link are disposed at an initial angle at said toggle pivot point during said first phase; and said toggle angle increases during said transition and second phase.

8. The hand tool of claim 7, wherein:

said cam assembly includes a spring and a release pin;

said handle member includes a release pin tab extending toward said release pin;

said cam member having a cam surface adjacent to said tension member;

said cam pivotably attached to said flat member;

said spring coupled to said cam member and to said first hand tool member assembly and biasing said cam into engagement with said tension assembly;

said release pin disposed on said cam member;

said release pin tab structured to contact said release pin during said first phase thereby preventing said cam from engaging said tension member and, upon said jaw portions contacting a workpiece, to move away from said release pin, thereby allowing said spring to move said cam surface into engagement with said tension member.

9. The hand tool of claim 8, wherein said tension member is straight.

10. The hand tool of claim 8, wherein said tension member is arced having a radius, generally equal to the distance between the second phase pivot pin and the point where said first hand tool member assembly handle portion.

11. The hand tool of claim 1 wherein said second hand tool member assembly includes a locking assembly structured to lock the toggle joint at a fixed angle.

12. The band tool of claim 1 wherein said first hand tool member assembly includes laminations of sheet metal.

13. The hand tool of claim 12 wherein said first hand tool member assembly sheet metal laminations are sheet metal stampings or cuttings.

14. The hand tool of claim 1 wherein said second hand tool member assembly includes laminations of sheet metal.

15. The hand tool of claim 14 wherein said second hand tool member assembly sheet metal laminations are sheet metal stampings or cuttings.

16. The hand tool of claim 1 wherein:

said first hand tool member assembly jaw portion includes a closing surface;

said second hand tool member assembly jaw portion includes a closing surface; and where said first hand tool member assembly closing surface and said second hand tool member assembly closing surface are generally parallel.

17. The hand tool of claim 16 wherein:

said first hand tool member assembly closing surface and said second hand tool member assembly closing surface are shearing surfaces.

18. The hand tool of claim 16 wherein:

said first hand tool member assembly closing surface is an anvil surface; and said second hand tool member assembly closing surface is a cutting surface.

19. The hand tool of claim 16 wherein:

said first hand tool member assembly closing surface is a recess surface; and said second hand tool member assembly closing surface is a projection surface.

20. The hand tool of claim 16 wherein:

said first hand tool member assembly closing surface is a punching surface; and said second hand tool member assembly closing surface is a die surface.

21. The hand tool of claim 16 wherein:

said first hand tool member assembly closing surface is a first notched surface; and said second hand tool member assembly closing surface is a second notched surface.

22. The hand tool of claim 16 wherein:

said first hand tool member assembly closing surface is a first clamp surface; and said second hand tool member assembly closing surface a second clamp surface.

23. A hand tool comprising:

a first hand tool member assembly having a jaw portion, a handle portion, a tension assembly, an elongated first link and a cam assembly;

said first link pivotably coupled at one end to said first hand tool member assembly handle portion at a first link pivot point and coupled at the other end to said cam assembly;

a second hand tool member assembly having a movable member with a jaw portion, a handle member and an elongated second link;

said second link pivotably coupled at one end to said first hand tool member assembly handle portion at a first jaw portion pivot point and pivotably coupled at the other end to said handle member at a toggle pivot point;

said handle member pivotably coupled to said movable member at a handle member pivot point;

said movable member pivotably coupled to said cam assembly at a second jaw portion pivot point;

wherein the distance between said first link pivot point and said second jaw portion pivot point is about the same as the distance between said first jaw portion pivot point and said handle member pivot point; and whereby said first link pivot point, said second jaw portion pivot point, said first jaw portion pivot point and said handle member pivot point form a parallelogram.

24. The hand tool of claim 23 wherein:

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first hand tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

25. The hand tool of claim 23 wherein said first member assembly jaw portion and said second member assembly jaw portion move generally parallel to each other during said first phase.

26. A shearing tool comprising:

a first hand tool member assembly having a jaw portion, a tension assembly, and a cam assembly;

a second hand tool member assembly having a jaw portion;

a jaw portion first pivot point coupling said first hand tool member assembly to said second member assembly;

a jaw portion second pivot point coupling said first hand tool member assembly to said second member assembly, said jaw portion second pivot point located closer to said first member and second member jaw portions than said jaw portion first pivot point;

said first hand tool member assembly jaw portion includes a closing surface;

said second hand tool member assembly jaw portion includes a closing surface;

said first hand tool member assembly closing surface and said second hand tool member assembly closing surface are shearing surfaces;

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first hand tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

27. The shearing tool of claim 26 wherein:

said first hand tool member assembly jaw portion closing surface is on a first blade; and said second hand tool member assembly jaw portion closing surface is on a second blade.

28. A cutting tool comprising:

a first hand tool member assembly having a jaw portion, a tension assembly, and a cam assembly;

a second hand tool member assembly having a jaw portion;

a jaw portion first pivot point coupling said first hand tool member assembly to said second member assembly;

a jaw portion second pivot point coupling said first hand tool member assembly to said second member assembly, said jaw portion second pivot point located closer to said first member and second member jaw portions than said jaw portion first pivot point;

said first hand tool member assembly jaw portion includes a closing surface;

said second hand tool member assembly jaw portion includes a closing surface;

said first hand tool member assembly closing surface is an anvil surface;

said second hand tool member assembly closing surface is a cutting surface;

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first band tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

29. The cutting tool of claim 28 wherein:

said first hand tool member assembly jaw portion anvil surface is on a plug; and said second hand tool member assembly jaw portion cutting surface is on a wedge shaped blade.

30. A crimping tool comprising:

a first hand tool member assembly having a jaw portion, a tension assembly, and a cam assembly;

a second hand tool member assembly having a jaw portion;

a jaw portion first pivot point coupling said first hand tool member assembly to said second member assembly;

a jaw portion second pivot point coupling said first hand tool member assembly to said second member assembly, said jaw portion second pivot point located closer to said first member and second member jaw portions than said jaw portion first pivot point;

said first hand tool member assembly jaw portion includes a closing surface;

said second hand tool member assembly jaw portion includes a closing surface;

said first hand tool member assembly closing surface is a recess surface;

said second hand tool member assembly closing surface is a projection surface;

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first hand tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

31. The crimping tool of claim 30 wherein:

said first hand tool member assembly jaw portion recess surface is on a recess plug; and said second hand tool member assembly jaw portion projection surface is on a plug having a projection.

32. A punch comprising:

a first hand tool member assembly having a jaw portion, a tension assembly, and a cam assembly;

a second hand tool member assembly having a jaw portion;

a jaw portion first pivot point coupling said first hand tool member assembly to said second member assembly;

a jaw portion second pivot point coupling said first hand tool member assembly to said second member assembly, said jaw portion second pivot point located closer to said first member and second member jaw portions than said jaw portion first pivot point;

said first hand tool member assembly jaw portion includes a closing surface;

said second hand tool member assembly jaw portion includes a closing surface;

said first hand tool member assembly closing surface is a punching surface;

said second hand tool member assembly closing surface is a die surface;

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first hand tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

33. The punch of claim 32 wherein:

said first hand tool member assembly jaw portion punching surface is on a punch plug; and said second hand tool member assembly jaw portion die surface is on a die plug.

34. An adjustable wrench comprising:

a first hand tool member assembly having a jaw portion, a tension assembly, and a cam assembly;

a second hand tool member assembly having a jaw portion;

a jaw portion first pivot point coupling said first hand tool member assembly to said second member assembly;

a jaw portion second pivot point coupling said first hand tool member assembly to said second member assembly, said jaw portion second pivot point located closer to said first member and second member jaw portions than said jaw portion first pivot point;

said first hand tool member assembly jaw portion includes a closing surface;

said second hand tool member assembly jaw portion includes a closing surface;

said first hand tool member assembly closing surface is a first notched surface;

said second hand tool member assembly closing surface is a second notched surface;

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first hand tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

35. The adjustable wrench of claim 32 wherein:

said first hand tool member assembly jaw portion first notched surface is on a first notched plug; and said second hand tool member assembly jaw portion second notched surface is on a second notched plug.

36. An adjustable wrench comprising:

a first hand tool member assembly having a jaw portion, a tension assembly, and a cam assembly;

a second hand tool member assembly having a jaw portion;

a jaw portion first pivot point coupling said first hand tool member assembly to said second member assembly;

a jaw portion second pivot point coupling said first hand tool member assembly to said second member assembly, said jaw portion second pivot point located closer to said first member and second member jaw portions than said jaw portion first pivot point;

said first hand tool member assembly jaw portion includes a closing surface;

said second hand tool member assembly jaw portion includes a closing surface;

said first hand tool member assembly closing surface is a first clamp surface;

said second hand tool member assembly closing surface a second clamp surface;

said first hand tool member assembly jaw portion and said second hand tool member assembly jaw portion structured to close together in a three-phase motion consisting of a first pivot phase, a transition phase and a second pivot phase, said first hand tool member assembly jaw portion and said second hand tool member assembly jaw portion pivoting relative to each other about said jaw portion first pivot point during said first pivot phase and pivoting relative to each other about said jaw portion second pivot point during said second pivot phase; and said cam assembly structured to engage said tension assembly when said first hand tool member assembly jaw portion and said second hand tool member assembly jaw portion contact a workpiece thereby initiating said transition phase between said first pivot phase and said second pivot phase wherein said rotation about said jaw portion first pivot point is halted causing said jaw portions to rotate about said jaw portion second pivot point.

37. The adjustable wrench of claim 32 wherein:

said first hand tool member assembly jaw portion includes a first C-shaped member;

said first hand tool member assembly jaw portion first clamp surface is on the distal end of said first C-shaped member;

said second hand tool member assembly jaw portion includes a second C-shaped member; and said second hand tool member assembly jaw portion second clamp surface is on the distal end of said second C-shaped member.

* * * * *

UNITED STATES PATENT AND TRADEMARK OFFICE

CERTIFICATE OF CORRECTION

PATENT NO. : 6,862,962 B1
DATED : March 8, 2005
INVENTOR(S) : Gerald Vincent Delbrugge, Jr et al.

It is certified that error appears in the above-identified patent and that said Letters Patent is hereby corrected as shown below:

Column 21,
Line 1, “band” should read -- hand --.

Column 23,
Line 50, “band” should read -- hand --.

Signed and Sealed this

Seventh Day of June, 2005

JON W. DUDAS
*Director of the United States Patent and Trademark Office*